US006246841B1

(12) United States Patent
Merrifield et al.

(10) Patent No.: US 6,246,841 B1
(45) Date of Patent: Jun. 12, 2001

(54) REMOVABLE TONER CARTRIDGE

(75) Inventors: David Lee Merrifield; Benjamin Keith Newman, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/567,724

(22) Filed: May 10, 2000

(51) Int. Cl.[7] ..... G03G 15/08; G03G 15/00
(52) U.S. Cl. ..... 399/27; 399/113
(58) Field of Search ..... 399/27, 113; 73/296

(56) References Cited

U.S. PATENT DOCUMENTS 5,061,959 * 10/1991 Kinoshita et al. ..... 399/113
5,802,419 9/1998 Sakurai et al. .
5,893,007 * 4/1999 Lim ..... 399/27

* cited by examiner

*Primary Examiner*—Joan Pendegrass
(74) *Attorney, Agent, or Firm*—John A. Brady

(57) ABSTRACT

The weight of toner remaining at any time in a developer housing of a removable toner cartridge installed in a laser printer is determined by ascertaining the weight of the developer housing with the toner when printing is interrupted. The weight of the developer housing with the toner is ascertained through determining the magnitude of a rear reaction force on the side of the developer housing having the input for rotating a developer roll in the developer housing and then subtracting the weight of the developer housing from the weight of the developer housing with the toner. Next, the weight of the remaining toner is correlated to the determined rear reaction force. Then, the amount of the remaining toner is displayed to a user of the laser printer as a percentage of the initial total toner, either numerically or by a bar graph, for example. The developer housing is slidably received in a cleaner housing of the removable toner cartridge and is releasably connected thereto by a pair of biasing springs, which must be at different angles to a line passing through the centers of the developer roll and a photoconductive drum, which is rotatably mounted in the cleaner housing.

37 Claims, 19 Drawing Sheets

REMOVABLE TONER CARTRIDGE

FIELD OF THE INVENTION

This invention relates to a removable toner cartridge used in an image forming apparatus and, more particularly, to an arrangement for ascertaining the level of usable toner in a removable toner cartridge at any time throughout its use in a laser printer or an electrophotographic copier by determining the weight of the toner.

BACKGROUND OF THE INVENTION

A laser printer has a removable toner cartridge disposed therein for providing a supply of toner. The removable toner cartridge includes a photoconductive drum rotatably supported in a cleaner housing and a developer roll rotatably supported in a developer housing, which is slidably received in the cleaner housing. The developer roll transfers toner from the developer housing to the photoconductive drum when both are rotating to print a latent image on a recording medium.

Users of laser printers desire to know when the level of the usable toner in the removable toner cartridge is reaching the usable level at which quality printing will not occur. Various systems for sensing the amount of toner remaining in the removable toner cartridge have previously been suggested.

One sensing system has employed an optical sensor peering through a window defining a portion of a toner sump wall in the removable toner cartridge in which the toner is contained. When the optical sensor sees light through the sump window, a signal is produced to indicate to the user that the amount of remaining toner is low. However, this signal does not provide any indication of the level of the toner remaining in the removable toner cartridge but only that it is lower than a predetermined value. Because users print different quantities of sheets of a recording medium during a fixed period of time such as a day, for example, the indication of a low toner level might be satisfactory for a user printing a relatively large number of sheets of a recording medium but not satisfactory for a user printing a relatively small number of sheets of a recording medium during the same time period or vice versa.

Another sensing system has employed a torque sensing mechanism for sensing the torque driving a stirring paddle for the toner. When the torque required to stir the toner decreases below a minimum value, the torque sensing mechanism signals to the user of the laser printer that the level of the toner is low. The torque at any time during the cartridge life is related to the level of the remaining toner. Thus, this system is used to estimate the level of the remaining toner in the cartridge. However, this system is complex, relatively expensive, and can fail from a number of different causes.

Furthermore, in this torque sensing mechanism, the range of measurement is a relatively small percentage of the toner total load. Therefore, only about 30% of a full toner load is within the toner level measuring range of the torque sensing mechanism. Thus, the torque sensing mechanism does not enable measurement of substantially the entire range of the toner load.

U. S. Pat. No. 5,802,419 to Sakurai et al mentions various types of detecting mechanisms capable of detecting whether the amount of toner remaining in the removable toner cartridge is no more than a predetermined value. These include a mechanism employing a capacity detecting system, a mechanism employing a magnetic sensor, a light transmission type mechanism, and a mechanism that detects the weight of the toner. However, there is no discussion of how the weight of the remaining toner would be ascertained, and there is no suggestion that such mechanism is capable of determining the level of toner from detecting the weight of the toner. There also is no suggestion of using the detected weight of the toner to determine its level at any time.

SUMMARY OF THE INVENTION

The present invention determines the level of the toner through ascertaining the weight of the remaining toner in the removable toner cartridge at any time. This is accomplished by determining the magnitude of a reaction force, which is created by the developer housing of the removable toner cartridge including the amount of toner therein. The magnitude of the reaction force is converted to the weight of the toner in the developer housing of the removable toner cartridge.

The reaction force is measured by any low deflection force measurement device supported by the laser printer. The preferred low deflection force measurement device is a load cell.

The reaction force is transmitted from the developer housing through a single support surface on the developer housing engaging a roller, for example, connected to the load cell on the laser printer. The support surface is preferably a flat surface extending from the outer wall of the developer housing on one side thereof. It should be understood that the support surface also could be at the rear of the developer housing at a point between its sides if the laser printer had a different architecture.

Accordingly, since only one side of the developer housing is supported by the laser printer, the present invention measures a single reaction force from the developer housing. The magnitude of this reaction force is then correlated to the amount of toner in the developer housing of the removable toner cartridge.

The reaction force is minimally affected by mechanical noise variables. The mechanical noise variables are due to varying forces over which there is no control except within a specific range.

The developer housing is slidably received in a cleaner housing of the removable toner cartridge and is resiliently connected thereto by two bias springs on opposite sides of the developer housing being connected to opposite sides of the cleaner housing so that the developer housing can roll or slide in the cleaner housing. These two bias springs have standard manufacturing tolerances that result in significant variation from spring to spring.

Accordingly, it is necessary to decrease the vertical component of the force created on the developer housing by the varying spring forces to a minimum. This is accomplished by disposing one of the bias springs at a relatively small angle to a line connecting the centers of the developer roll and the photoconductive drum such as 2°–4°, for example, and the other of the bias springs at a slightly larger angle to the line connecting the centers of the developer roll and the photoconductive drum such as 22°–24°, for example. It should be understood that the line connecting the centers of the developer roll and the photoconductive drum is at a slightly inclined angle to the horizontal because of the geometry of the removable toner cartridge.

The bias spring having the smaller angle is attached to the side of the developer housing transmitting the reaction force. This creates a negligible vertical component so that it does not have an effect on the magnitude of the transmitted rear reaction force since the transmitted rear reaction force is substantially vertical.

In determining forces acting on the developer housing, each side of the developer housing must have its forces treated independently. All the forces acting on the developer housing are used to determine the magnitude of the rear reaction force.

In the present invention, maximum and minimum mechanical noise level variables are determined. Then, using all of the combinations of every mechanical noise variable at both its minimum and maximum levels, the desirable mechanical parameters are determined that would result in the noise variables producing a minimum effect on the rear reaction force when determining the maximum level of toner. This same mechanical noise variation remain at the same values for other levels of toner because the mechanical noise variation is independent of the toner level.

Accordingly, the statics of the developer housing as a free body are mathematically and experimentally optimized to have the measured rear reaction force as closely related to the toner weight in the developer housing as possible and the effect of the mechanical noise variation minimized. That is, the magnitude of each measured rear reaction force has a relation to a specific toner weight and is insensitive to mechanical noise variation.

An object of this invention is to provide an accurate, full range measurement of toner level in a removable toner cartridge of a laser printer or an electrophotographic copier.

Another object of this invention is to provide a system for obtaining the weight of the toner in a removable toner cartridge of a laser printer or electrophotographic copier by measuring a single reaction force produced by a developer housing of the removable toner cartridge.

A further object of this invention is to provide a less costly removable toner cartridge for use in a laser printer or an electrophotographic copier.

Still another object of this invention is to provide a method for ascertaining the amount of toner remaining at any time in a developer housing of a removable toner cartridge installed in an image forming apparatus.

A still further object of this invention is to provide a method of controlling the magnitudes of the forces acting on a developer housing of a removable toner cartridge installed in an image forming apparatus.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
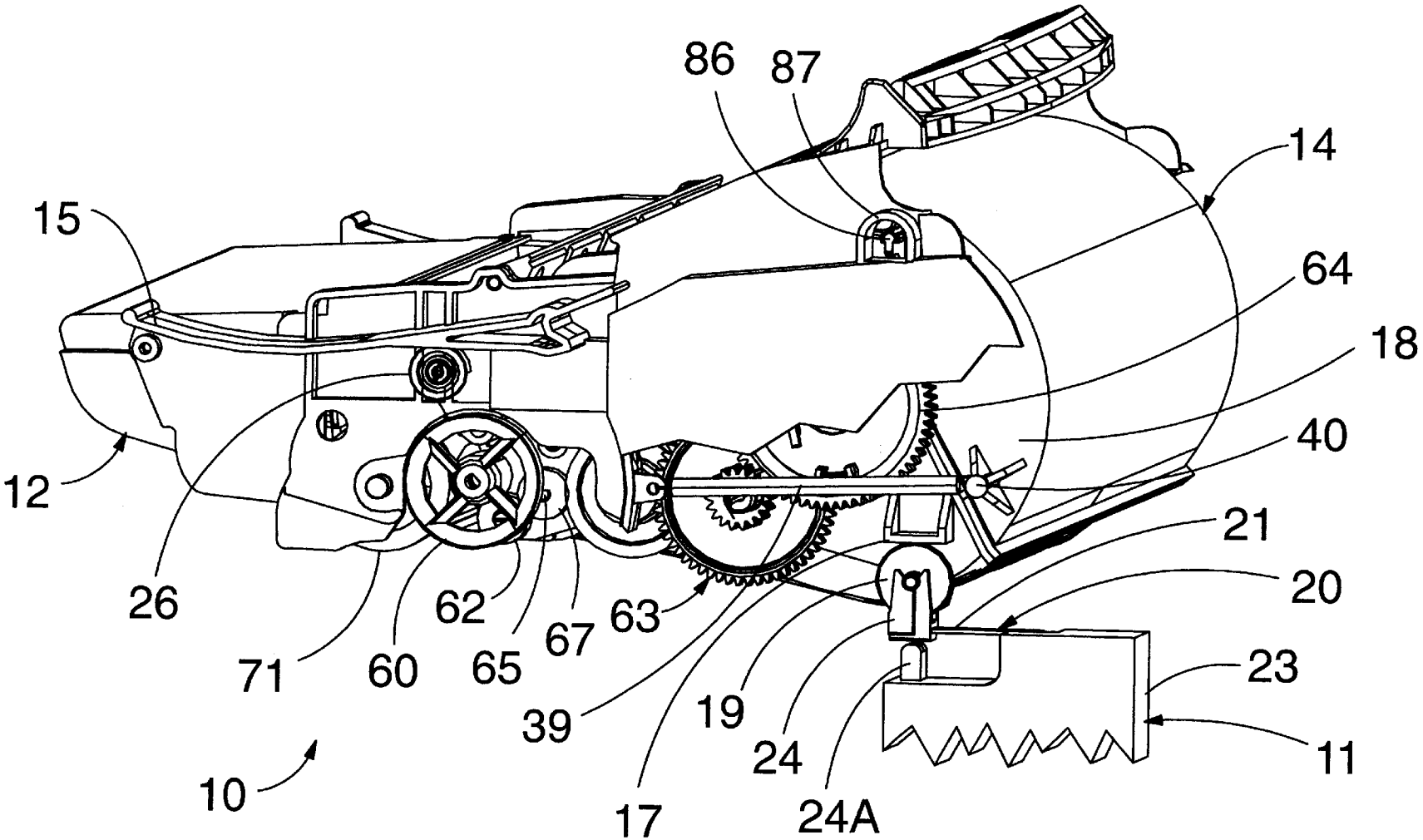
FIG. 1 is a perspective view of a removable toner cartridge in a laser printer with a portion of a side wall of a cleaner housing removed and a load cell mounted on a portion of the laser printer and taken from one side of the removable toner cartridge.

Referring to the drawings and particularly FIG. 1, there is shown a removable toner cartridge 10 for use in a laser printer 11. The removable toner cartridge 10 is formed of a cleaner housing 12 and a developer housing 14, which is slidably received in the cleaner housing 12 and resiliently connected thereto so that the developer housing 14 can roll or slide in the cleaner housing 12.

Figure 2:
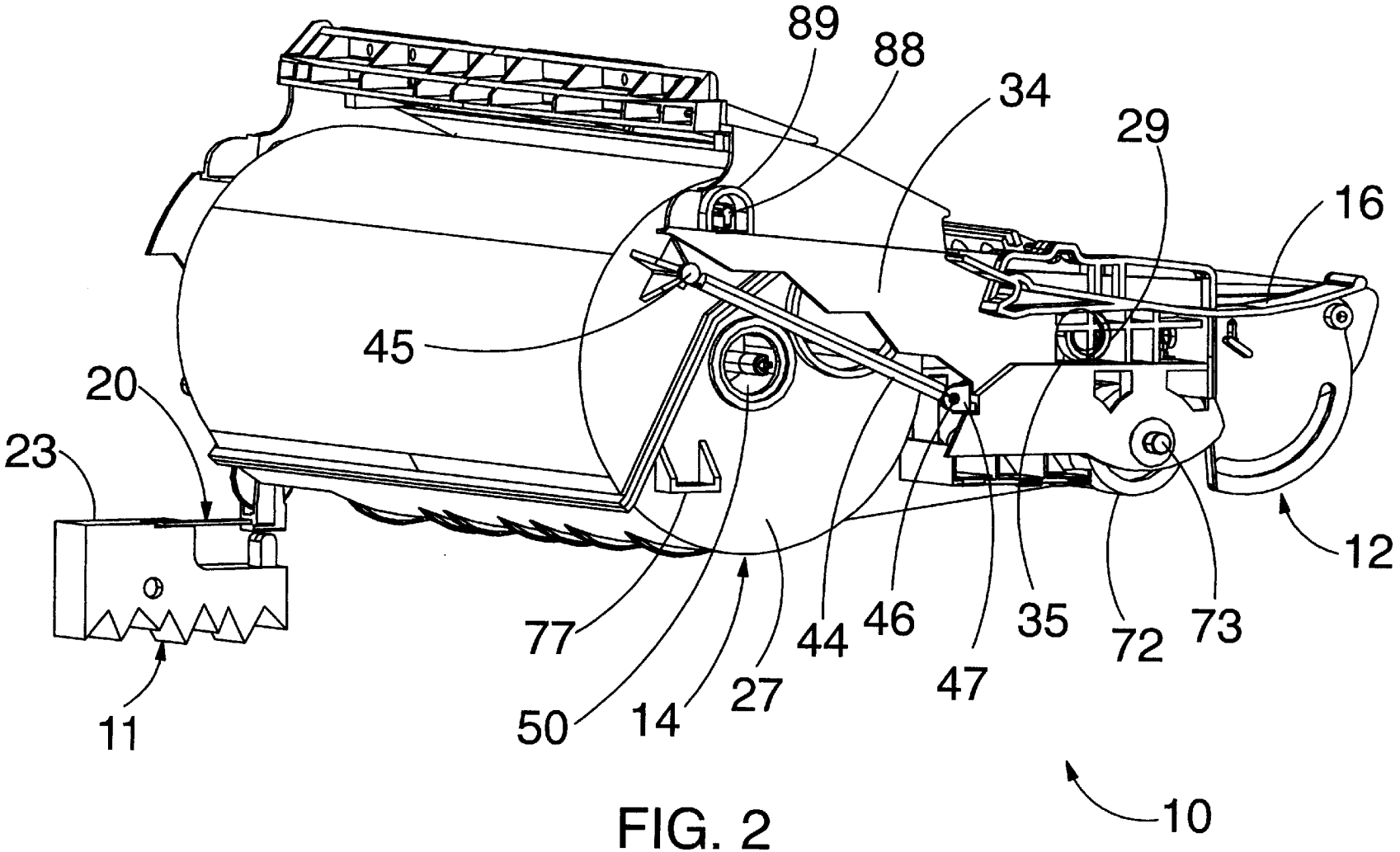
FIG. 2 is a perspective view of the removable toner cartridge of FIG. 1 with a portion of a side wall of the cleaner housing removed and a load cell mounted on a portion of the laser printer and taken from the opposite side of the removable toner cartridge to FIG. 1.

When the removable toner cartridge 10 is inserted into the laser printer 11, guide wings 15 and 16 (see FIG. 2), which are on opposite sides of the cleaner housing 12 adjacent its top, engage guides (not shown) in the laser printer 11 (see FIG. 1) in the manner more particularly shown and described in U. S. Pat. No. 5,875,378 to Campbell et al, which is owned by the assignee of this application. As the developer housing 14 is inserted into the cleaner housing 12, transverse alignment is insured by a positioning tab 16A (see FIG. 5) on the developer housing 14 entering a positioning slot (not shown) in the cleaner housing 12 (see FIG. 1).

Figure 3:
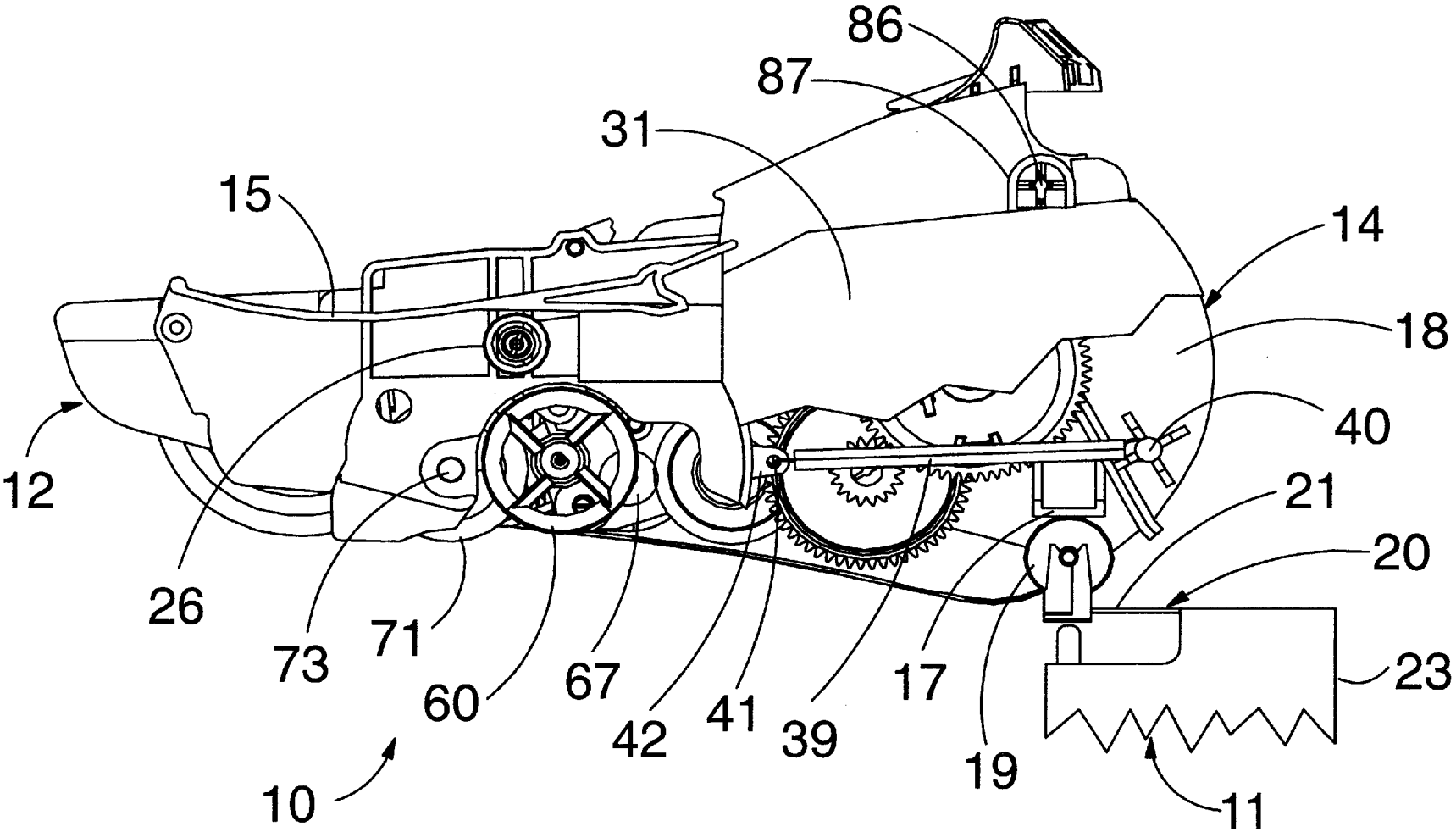
FIG. 3 is a side elevation view of the removable toner cartridge of FIG. 1 with a portion of a side wall of the cleaner housing removed and a load cell mounted on a portion of the laser printer and taken from the same side of the removable toner cartridge as FIG. 1.

When the removable toner cartridge 10 is fully installed in the laser printer 11, a support surface 17 (see FIG. 3), which is preferably a substantially horizontal flat surface, of a side wall 18 of the developer housing 14 rests on a roller 19, which is supported by a load cell 20. This arrangement provides a point contact for transmission of the rear reaction force.

Figure 10:
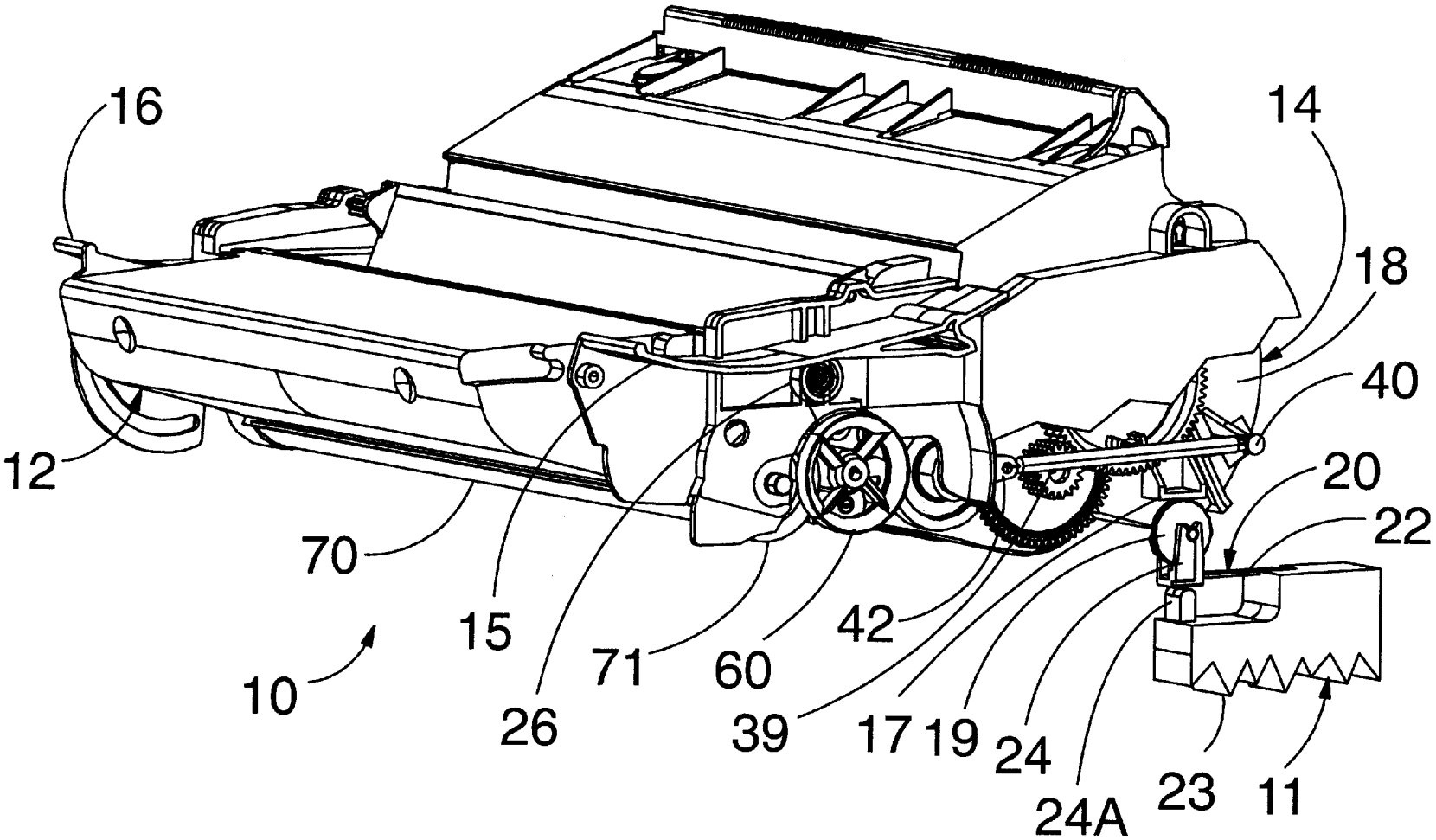
FIG. 10 is a perspective view of the removable toner cartridge of FIG. 1 with a portion of a side wall of the cleaner housing removed and a load cell mounted on a portion of the laser printer and taken from the same side as FIG. 1.
Figure 11:
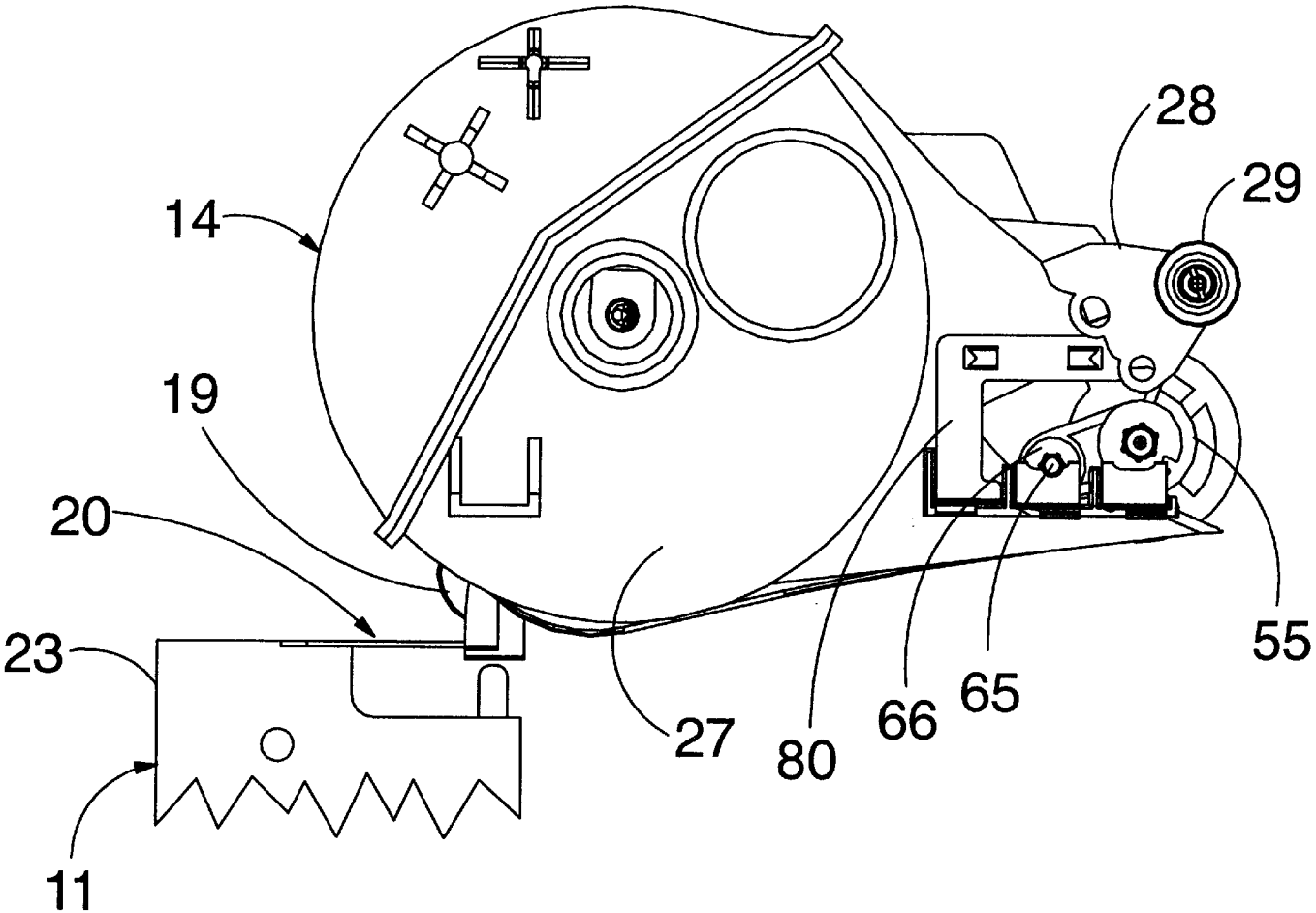
FIG. 11 is a side elevation view of the developer housing with a load cell mounted on a portion of the laser printer and taken from the opposite side to FIG. 4.

The load cell 20, which is supported by a frame 23 of the laser printer 11 and constitutes a force sensor, includes an arm 21 having a strain gauge 22 (see FIG. 10) or other suitable strain sensitive material mounted thereon. The arm 21 (see FIG. 1) has one end mounted on the frame 23 of the laser printer 11. The arm 21 has a roller support 24 at its other end for rotatably supporting the roller 19. The frame 23 has a stop 24A to limit downward movement of the arm 21 when the laser printer 11 is being transported or the removable toner cartridge 10 is being installed to prevent damage to the arm 21.

While the load cell 20 is preferably the force sensor, any other low deflection measuring device may be utilized as the force sensor. The only support of the developer housing 14 by the laser printer 11 is through the support surface 17 and the roller 19. This transmits the rear reaction force of the developer housing 14 to the load cell 20.

Figure 4:
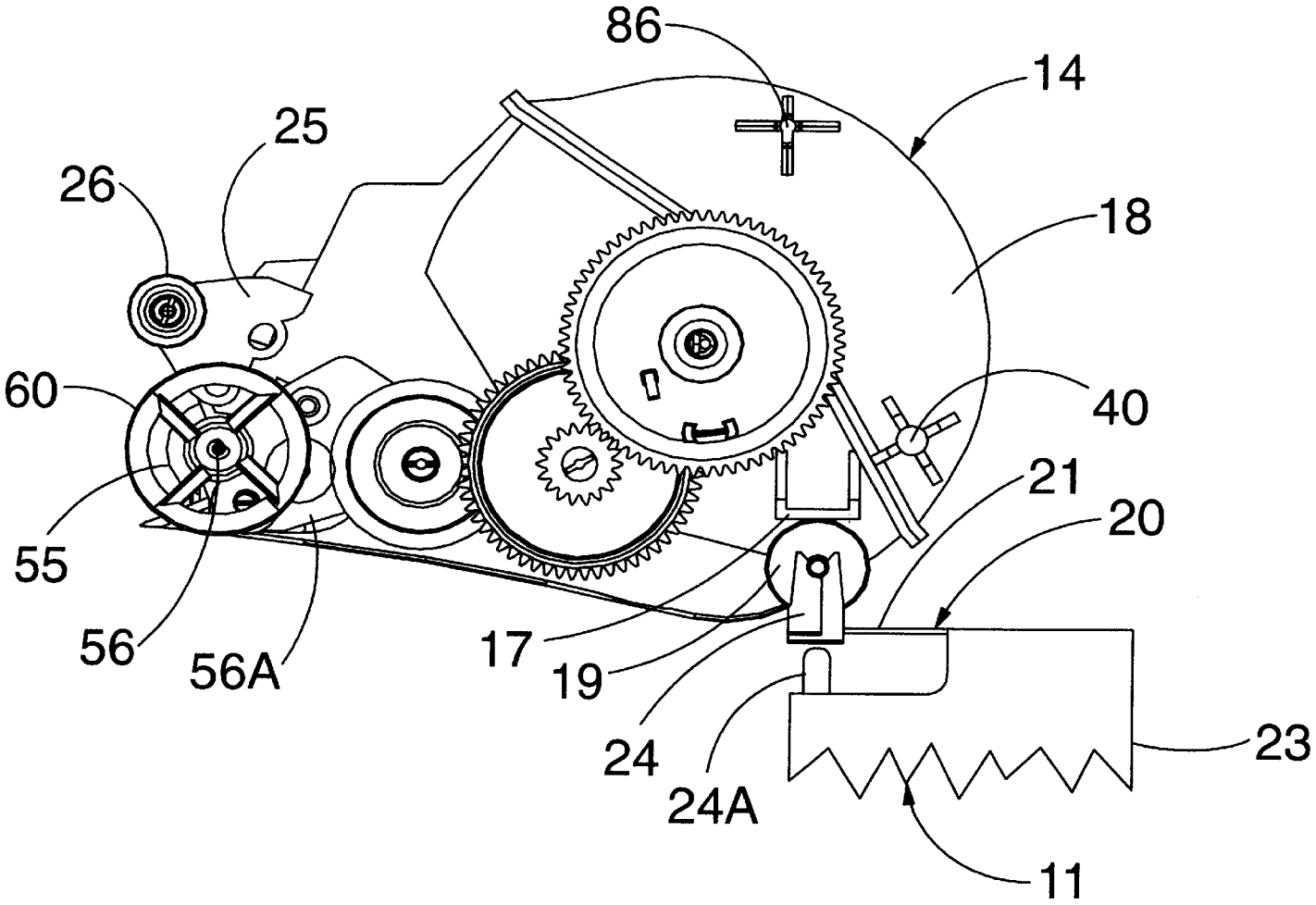
FIG. 4 is a side elevation view of the developer housing of the removable toner cartridge of FIG. 1 and a load cell mounted on a portion of the laser printer and taken from the same side of the removable toner cartridge as FIG. 3.

The side wall 18 of the developer housing 14 has an extension 25 (see FIG. 4) extending forwardly towards the cleaner housing 12 (see FIG. 3) to rotatably support a support roller 26 (see FIG. 4). A side wall 27 (see FIG. 6), which is substantially parallel to the side wall 18 (see FIG. 3), of the developer housing 14 has an extension 28 (see FIG. 7) rotatably supporting a support roller 29.

The support roller 26 (see FIG. 12) is disposed between an upper support shelf 30 on an inner surface of a side wall 31 (see FIG. 3) of the cleaner housing 12 and a lower support shelf 32 (see FIG. 12) on the inner surface of the side wall 31 (see FIG. 3) of the cleaner housing 12. Similarly, the support roller 29 (see FIG. 12) is disposed between an upper support shelf 33 on an inner surface of a side wall 34 (see FIG. 2) of the cleaner housing 12 and a lower support shelf 35 on the inner surface of the side wall 34 of the cleaner housing 12. This roller support arrangement enables the developer housing 14 to be slidably moved or rolled relative to the cleaner housing 12.

A biasing spring 39 (see FIG. 3), which is preferably an extension spring, resiliently connects one side of the developer housing 14 to one side of the cleaner housing 12. The spring 39 has one end connected to a post 40 extending outwardly from the side wall 18 of the developer housing 14 and its other end connected to a hole 41 in a tab 42 of the side wall 31 of the cleaner housing 12.

A biasing spring 44 (see FIG. 6), which is preferably an extension spring, resiliently connects the other side of the developer housing 14 to the other side of the cleaner housing 12. The spring 44 has one end connected to a post 45 extending outwardly from the side wall 27 of the developer housing 14 and its other end connected to a hole 46 in a tab 47 of the side wall 34 of the cleaner housing 12.

Figure 7:
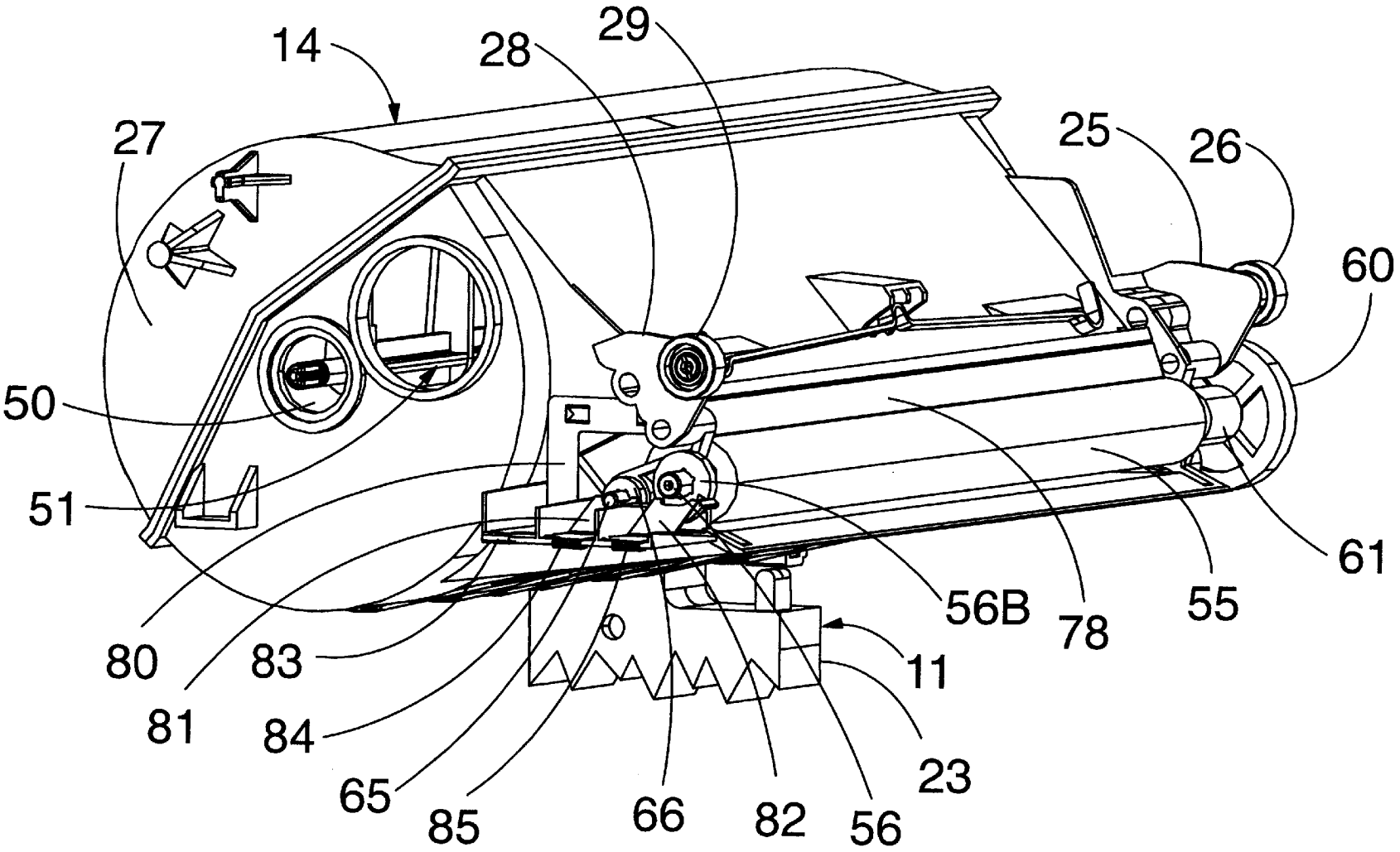
FIG. 7 is a perspective view of the developer housing and taken from the opposite side to FIG. 5.
Figure 8:
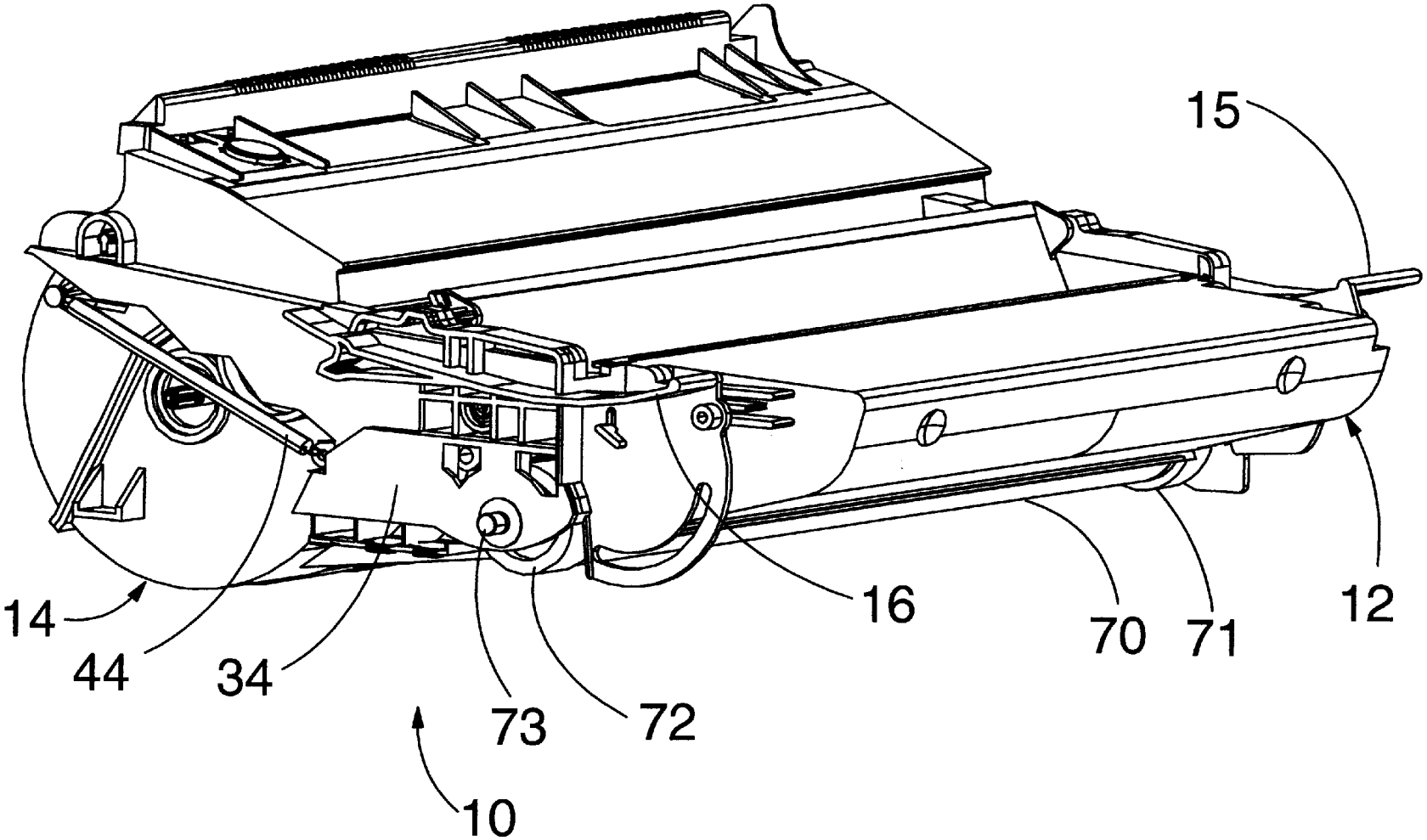
FIG. 8 is a perspective view of the removable toner cartridge of FIG. 1 with a portion of a side wall of the cleaner housing removed and taken from the same side as FIG. 2.
Figure 9:
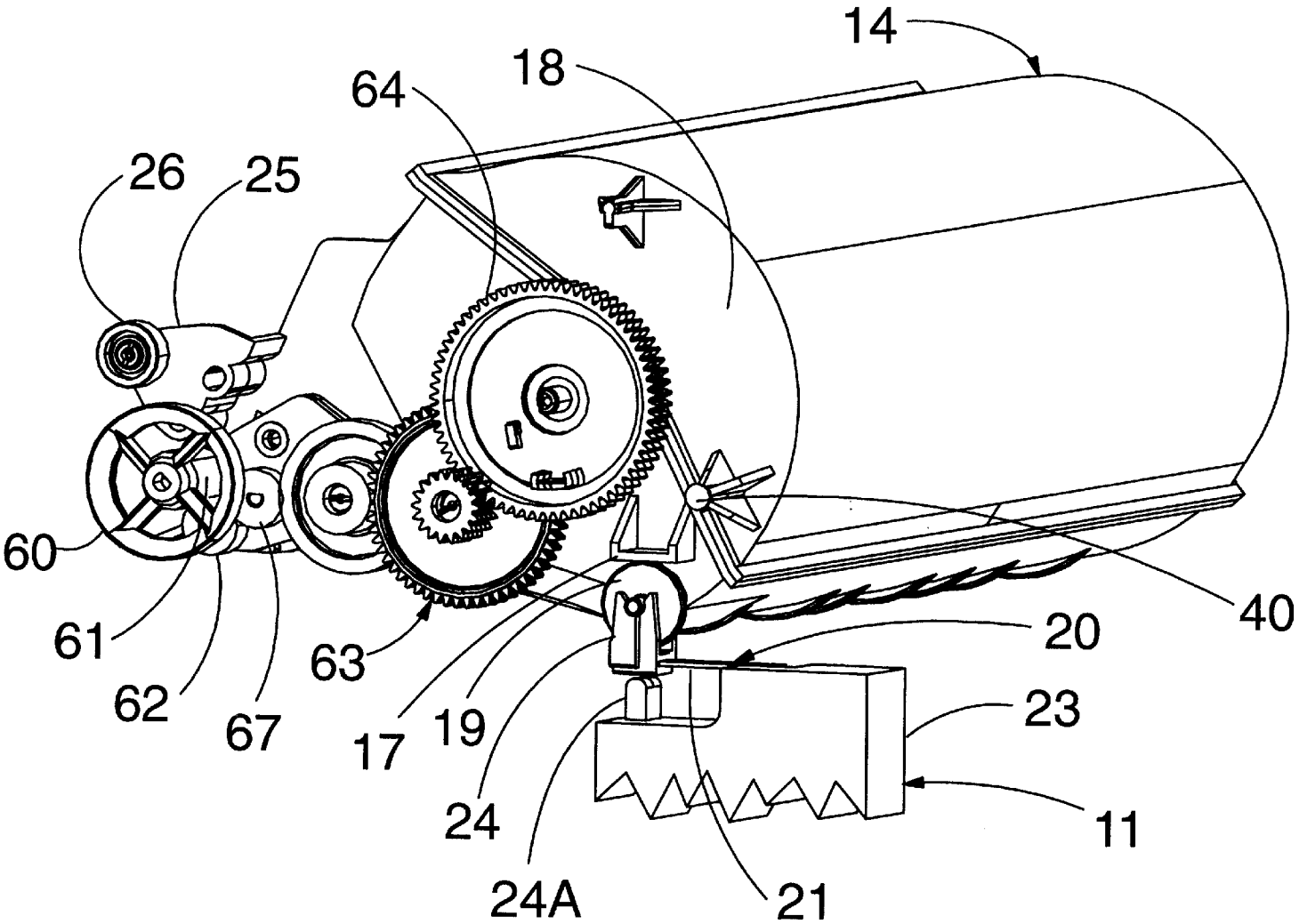
FIG. 9 is a rear perspective view of the developer housing and a load cell mounted on a portion of the laser printer and taken from the same side as FIG. 5.

The springs 39 (see FIG. 3) and 44 (see FIG. 6) are preferably disposed at different angles relative to a line connecting the centers of a developer roll 55 (see FIG. 7) and a photoconductive (PC) drum 70 (see FIG. 8). This enables the weight of toner within interior 50 (see FIG. 7) of the developer housing 14 to be determined by a rear reaction force produced on the roller 19 (see FIG. 1) by the support surface 17 on the side wall 18 of the developer housing 14.

The interior 50 (see FIG. 7) of the developer housing 14 provides a sump or hopper for containing the toner. The interior 50 of the developer housing 14 has a rotatable paddle assembly 51 therein. The paddle assembly 51 is driven in the manner more particularly shown and described in the aforesaid Campbell et al patent.

Figure 6:
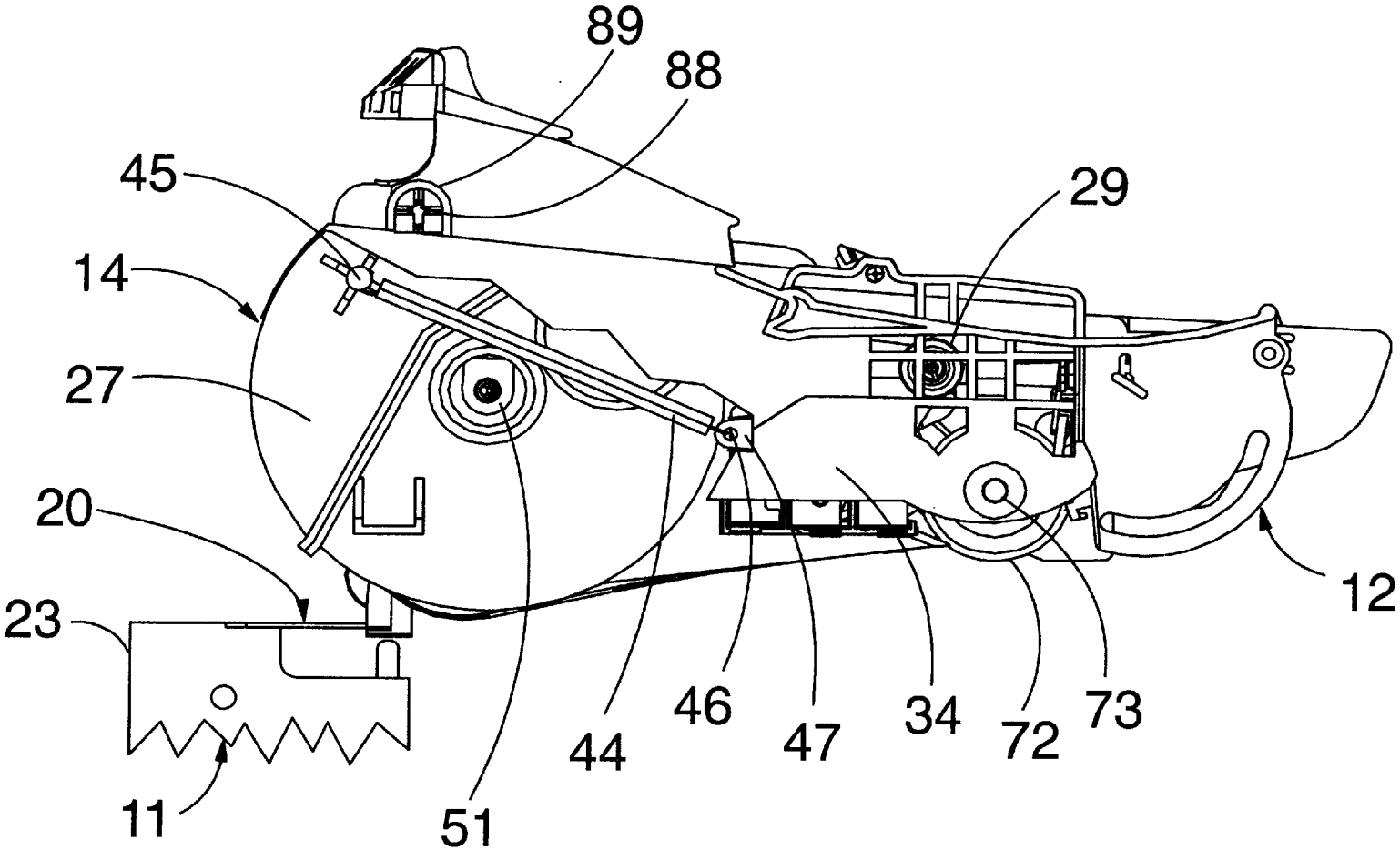
FIG. 6 is a side elevation view of the removable toner cartridge of FIG. 1 with a portion of a side wall of the cleaner housing removed and a load cell mounted on a portion of the laser printer and taken from the opposite side to FIG. 3.

The springs 39 (see FIG. 3) and 44 (see FIG. 6) exert different force vectors on opposite sides of the cleaner housing 12 because of the different angles to the line connecting the centers of the developer roll 55 (see FIG. 7) and the PC drum 70 (see FIG. 8) of the two springs 39 (see FIG. 3) and 44 (see FIG. 6). The spring 39 (see FIG. 3) is preferably disposed at an angle of 2° to the line connecting the centers of the developer roll 55 (see FIG. 7) and the PC drum 70 (see FIG. 8). The spring 44 (see FIG. 6) is preferably disposed at an angle of 24° to the line connecting the centers of the developer roll 55 (see FIG. 7) and the PC drum 70 (see FIG. 8).

The developer roll 55 (see FIG. 5), which is preferably formed of urethane, is rotatably supported at its opposite ends by the developer housing 14. The developer roll 55 is mounted on a steel shaft 56 having one of its ends rotatably supported in a bearing block 56A (see FIG. 4) attached to the side wall 18 of the developer housing 14 and its other end rotatably supported by a bearing 56B (see FIG. 7) in the side wall 27 of the developer housing 14.

One end of the steel shaft 56 (see FIG. 5) has a coupler 60 fixed thereto. The coupler 60 receives a drive element (not shown) from an Oldham coupler (not shown) within the laser printer 11 to rotatably drive the developer roll 55.

The steel shaft 56 also has a gear 61 (see FIG. 5) (teeth omitted) integrally formed with the coupler 60 and interior of the coupler 60 to mesh with a gear 62 (see FIG. 1) (teeth omitted) of a gear train 63. The gear train 63 includes a gear 64 for rotating the paddle assembly 51 (see FIG. 7). Thus, the paddle assembly 51 rotates in the opposite direction of the rotation of developer roll 55.

A toner adder roller (not shown) is rotatably supported in the developer housing 14 in contact with the developer roll 55. The toner adder roller (not shown) is fixed to a steel shaft 65, which has one end rotatably supported by the bearing block 56A (see FIG. 4) in the side wall 18 of the developer housing 14. The other end of the steel shaft 65 (see FIG. 7) is rotatably supported by a bearing 66 in the side wall 27 of the developer housing 14.

A gear 67 (see FIG. 1) (teeth omitted) of the gear train 63 is mounted on the end of the steel shaft 65 for rotating the toner adder roller (not shown) at the same time that the developer roll 55 (see FIG. 7) is rotated in the same direction but having opposite surface directions. This results in the toner adder roller (not shown) scrubbing the old toner off the developer roll 55 for return to the interior 50 of the developer housing 14.

The developer roll 55 engages the PC drum 70 (see FIG. 8), which is a hollow aluminum tube having a photosensitive coating. The PC drum 70 has a pair of helical gears 71 (teeth omitted) and 72 (teeth omitted) attached to its hollow ends by being pressed thereon, for example.

The gears 71 and 72 are rotatably supported on a steel shaft 73. The steel shaft 73 has its ends fixed in the side walls 31 (see FIG. 3) and 34 (see FIG. 8) of the cleaner housing 12.

The gear 71 (see FIG. 1) is driven from a meshing gear (not shown) in the laser printer 11 when the removable toner cartridge 10 is fully installed in the laser printer 11. The laser printer motor, which drives the PC drum 70 (see FIG. 8) through the gear 71, also is preferably employed to drive the coupler 60 (see FIG. 1). The helical gear 72 (see FIG. 6) drives a transfer roller (not shown).

Figure 16:
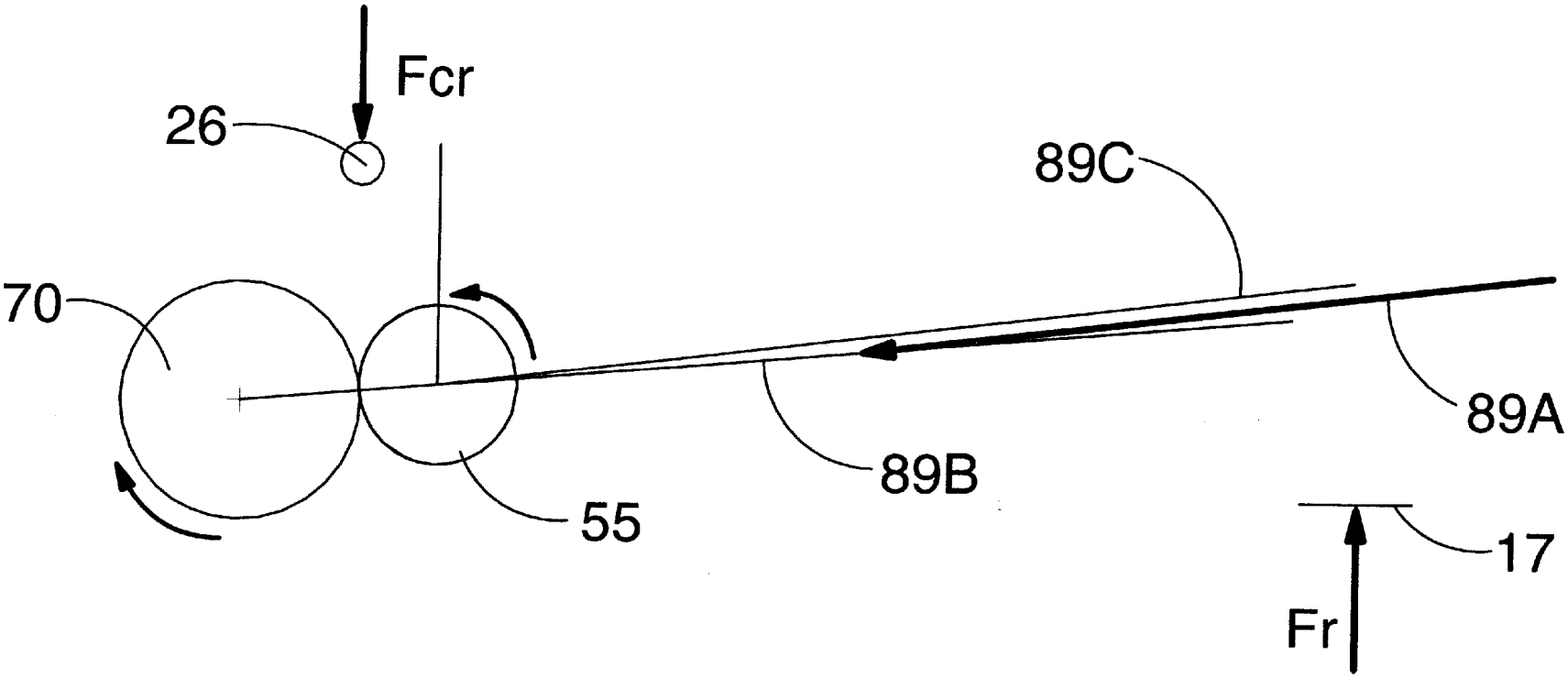
FIG. 16 is a schematic diagram showing the optimum position of the angle of one of the springs and the location of one of the front support rollers for slidably supporting the developer housing on the cleaner housing and taken from the same side as FIG. 1.

The biasing springs 39 (see FIG. 3) and 44 (see FIG. 6) continuously urge the developer roll 55 (see FIG. 1) into contact with the PC drum 70 (see FIG. 8) to form a nip therebetween as shown in FIG. 16. In the preferred embodiment, the axis of each of the support rollers 26 (see FIG. 5) and 29 is preferably in a vertical plane passing through the contact nip. The axes of the support rollers 26 and 29 are horizontal.

Figure 12:
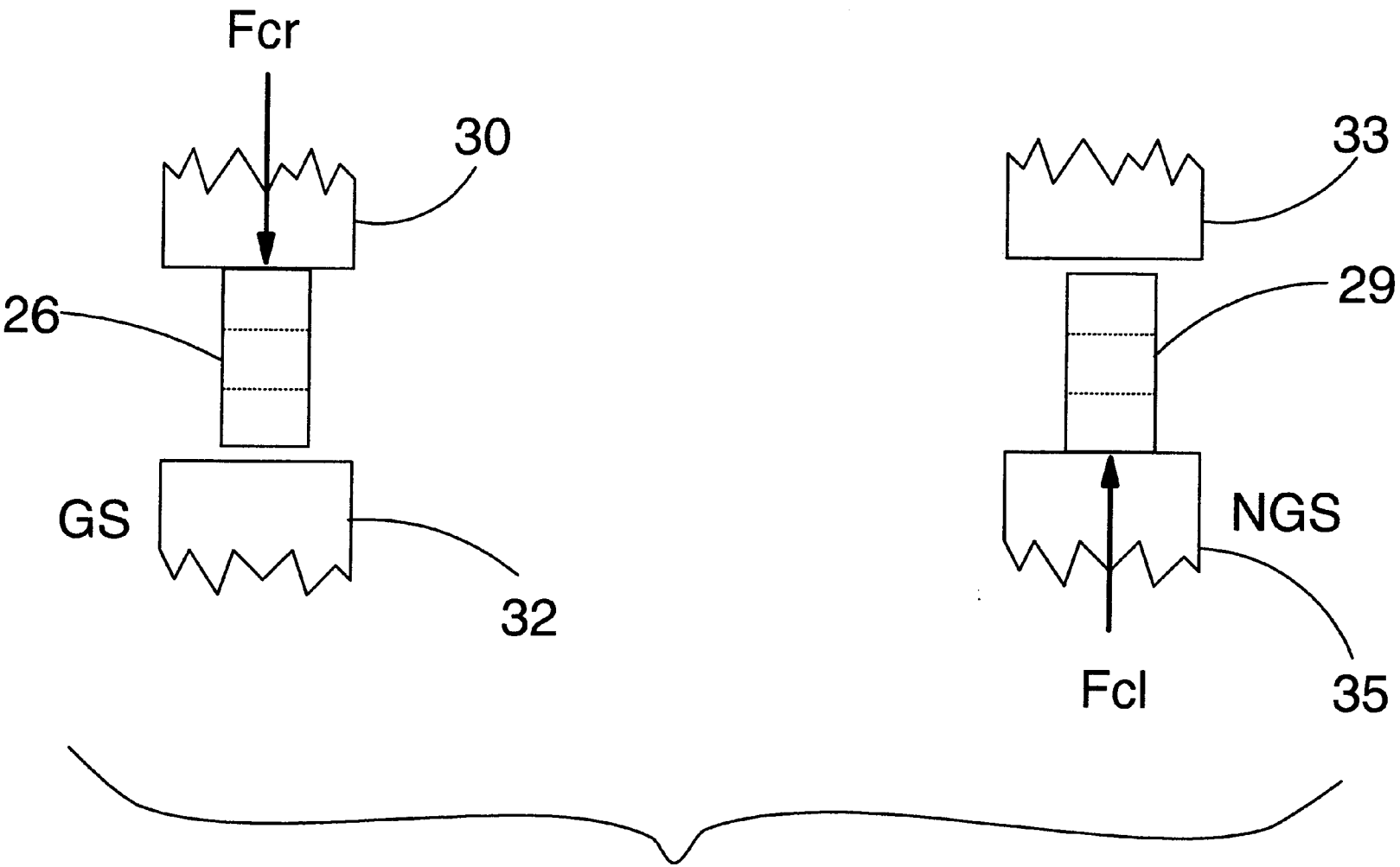
FIG. 12 is a schematic diagram of a portion of the removable toner cartridge of FIG. 1 and showing one arrangement of the relation between support rollers on the developer housing and support shelves on the cleaner housing for supporting the support rollers.

Because of the developer housing 14 being designed for support on only one of its sides at the engagement of the support surface 17 with the roller 19, the support roller 26 engages the upper support shelf 30 (see FIG. 12) of the cleaner housing 12 (see FIG. 3) while the support roller 29 (see FIG. 2) engages the lower support shelf 35 of the cleaner housing 12. As shown in FIG. 12, the support shelves 30 and 32 are disposed lower than the support shelves 33 and 35, respectively. This arrangement of the support shelves 30, 32, 33, and 35 insures that the axes of the support rollers 26 (see FIG. 5) and 29 are horizontal and aligned while the developer roll 55 and the PC drum 70 (see FIG. 8) are being driven by the laser printer motor. This arrangement is necessary because the only output of the rear reaction force is through the support surface 17 (see FIG. 5) engaging the roller 19.

Figure 19:
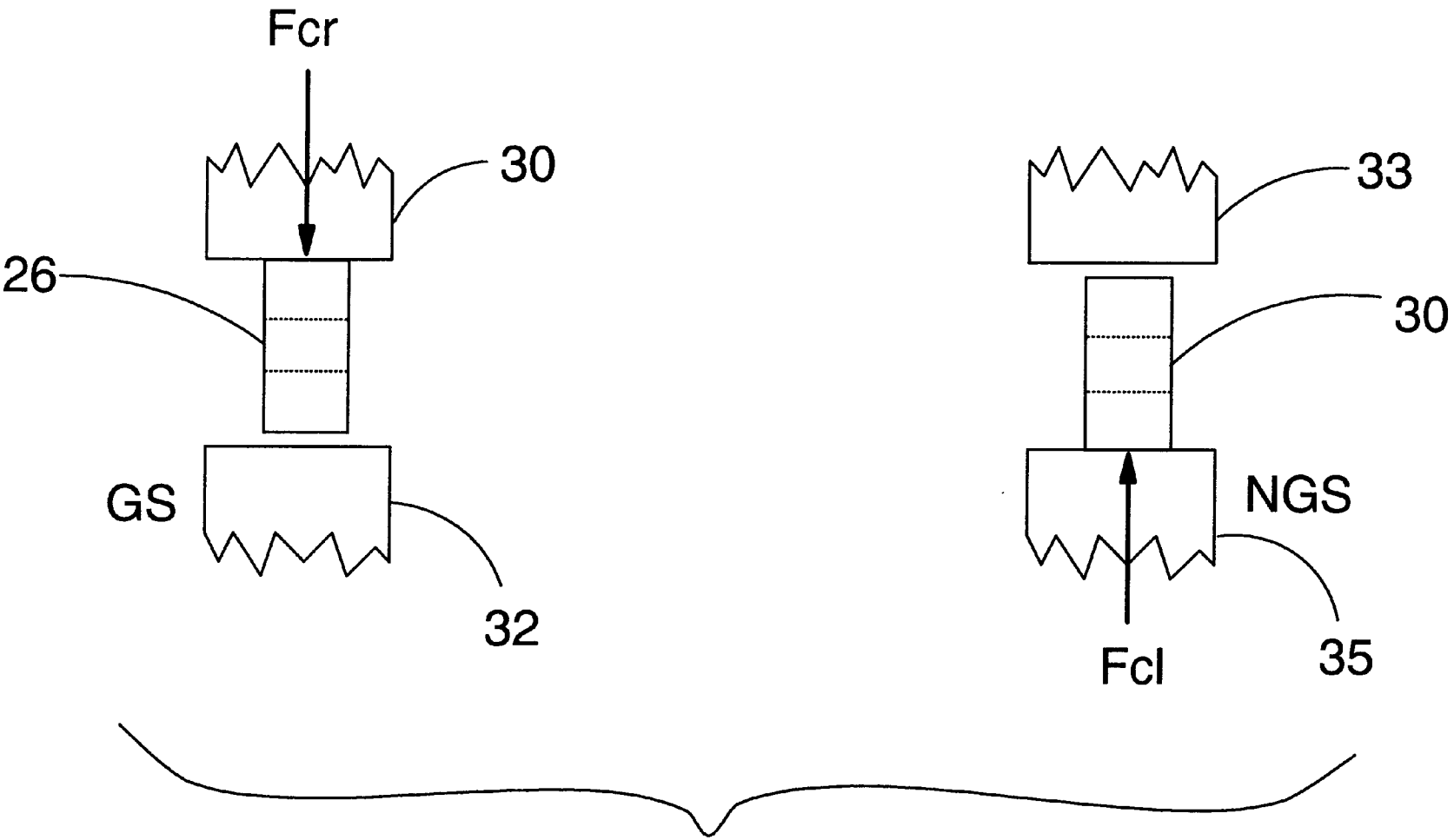
FIG. 19 is a schematic diagram of a portion of the removable toner cartridge of FIG. 1 and showing another arrangement of the relation between support rollers on the developer housing and support shelves on the cleaner housing for supporting the support rollers.

It should be understood that the upper support shelves 30 (see FIG. 19) and 33 could be in the same horizontal plane and the lower support shelves 32 and 35 could be in the same horizontal plane if the axes of the support rollers 26 and 29 were parallel to each other rather than aligned with each other. The support roller 26 would still engage the upper support shelf 30, and the support roller 29 would still engage the lower support shelf 35.

It also should be understood that it is only necessary for the support roller 26 to engage the upper shelf 30 and the support roller 29 to engage the lower shelf 35 when the support surface 17 (see FIG. 5) is supported by the side wall 18 of the developer housing 14. If the support surface 17 were replaced by a support surface 77 (see FIG. 2) on the side wall 27 (see FIG. 2) of the developer housing 14, then the support roller 26 (see FIG. 12) would engage the lower shelf 32 and the support roller 29 would engage the upper shelf 33.

As the PC drum 70 (see FIG. 8) rotates counterclockwise, any toner, which is not transferred during development, is scraped from the PC drum 70 by a cleaning blade (not shown) in the manner shown and described in the aforesaid Campbell et al patent. The cleaning blade is supported on a portion of the cleaner housing 12. The toner removed by the cleaning blade is collected in the interior of a collection box of the cleaner housing 12; the collected toner is discarded with the removable toner cartridge 10.

A doctor blade 78 (see FIG. 5) extends parallel with and is in pressure contact with the developer roll 55. The doctor blade 78 contacts the developer roll 55 at about 15° from the vertical toward the toner adder roller (not shown) in the interior 50 (see FIG. 7) of the developer housing 14 to meter a thin layer of the toner to the developer roll 55.

Figure 5:
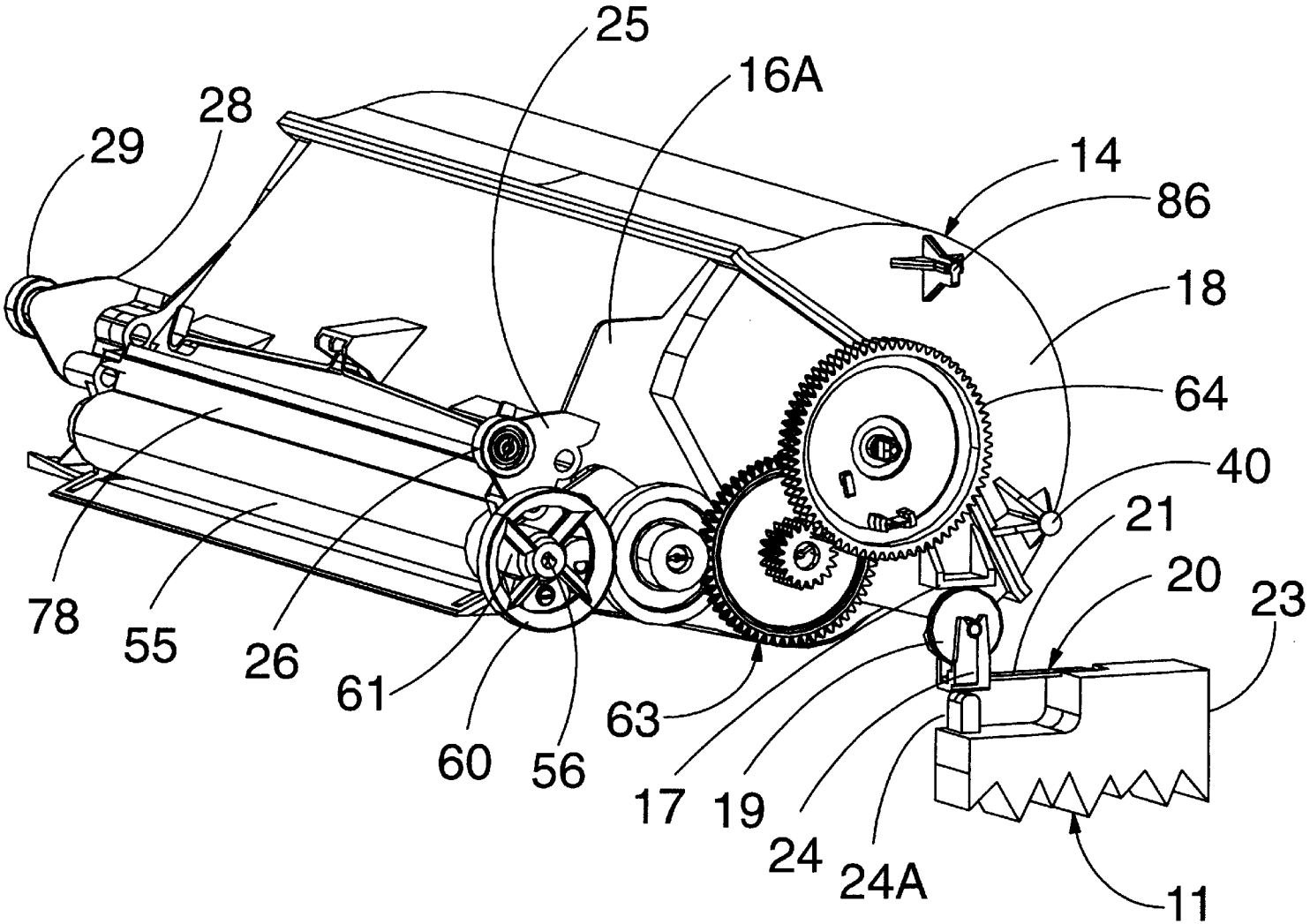
FIG. 5 is a perspective view of the developer housing of FIG. 4 and a load cell mounted on a portion of the laser printer.

A metal electrical contact 80 engages the doctor blade 78 (see FIG. 5). A metal electrical contact 81 (see FIG. 7) engages the bearing 66 that rotatably supports one end of the steel shaft 65 on which the toner adder roller (not shown) is mounted. A metal electrical contact 82 engages the bearing 56B that rotatably supports one end of the steel shaft 56 on which the developer roll 55 is mounted.

Outer ends 83, 84, and 85 of the metal electrical contacts 80, 81 and 82, respectively, bear against metal electrical contacts in the laser printer 11 (see FIG. 1) when the removable toner cartridge 10 is installed in the laser printer 11. This enables each of the metal electrical contacts 80 (see FIG. 7), 81, and 82 to receive electrical potential from the laser printer 11.

The side wall 18 (see FIG. 3) of the developer housing 14 has a limit post 86 extending outwardly therefrom for disposition within a limit stop 87 on the cleaner housing 12. The side wall 27 (see FIG. 2) of the developer housing 14 has a limit post 88 extending outwardly therefrom for disposition within a limit stop 89 on the cleaner housing 12. This arrangement limits the slidable or rolling movement of the developer housing 14 relative to the cleaner housing 12 when the removable toner cartridge 10 is installed in the laser printer 11.

As previously mentioned, the statics of the developer housing 14 (see FIG. 1) as a free body are mathematically and experimentally optimized to have the rear reaction force exerted by the support surface 17 of the developer housing 14 as measured by the load cell 20 to be as close as possible to the weight of the toner in the developer housing 14 at any time with respect to the mechanical noise variables acting on the developer housing 14. The forces of the various utilized mechanical noise variables are shown in FIG. 13.

Figure 13:
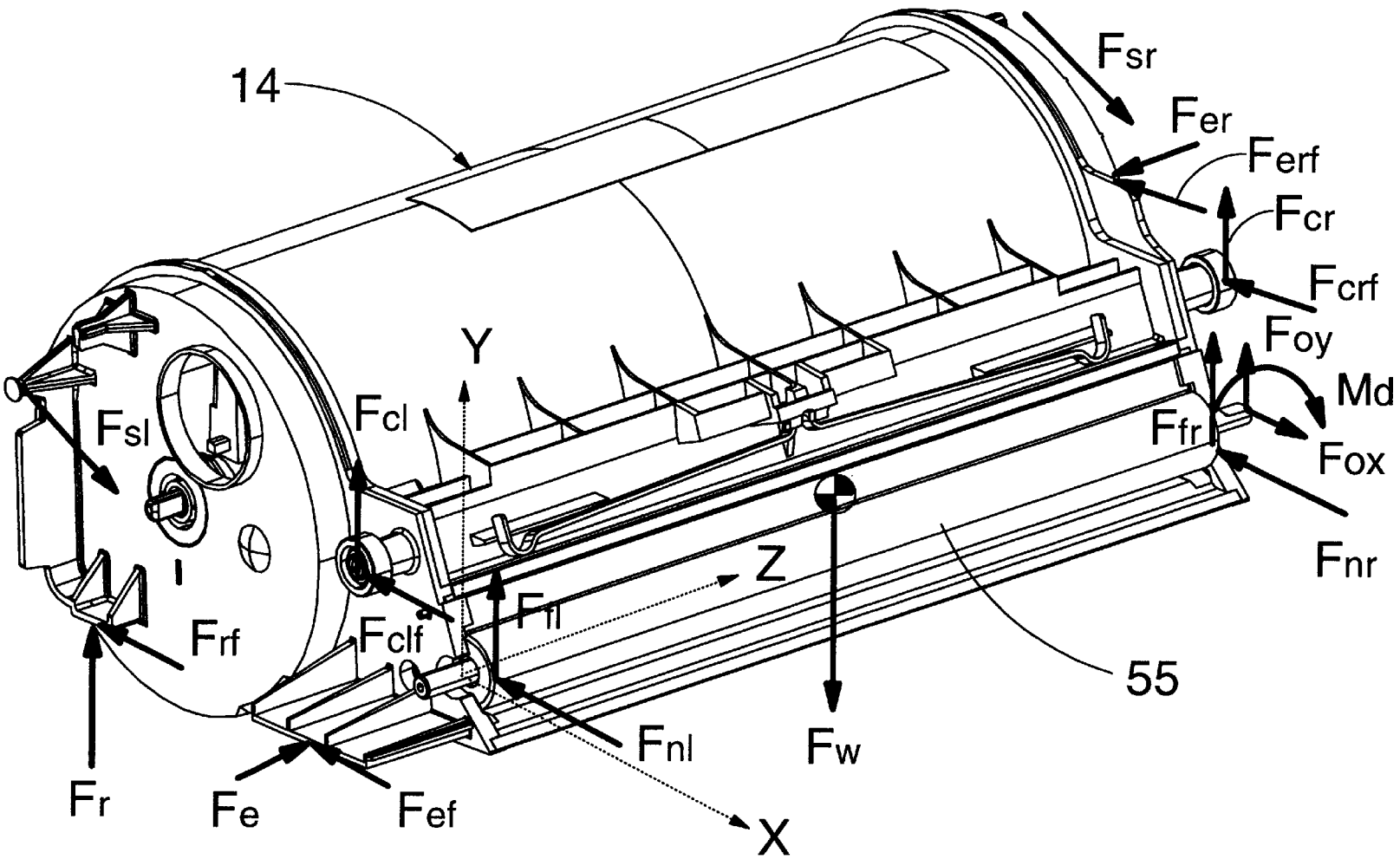
FIG. 13 is a three dimensions force diagram of the developer housing as a free body with the rear reaction force and the rear reaction friction force shown on the opposite side of the removable toner cartridge from where they occur in the preferred embodiment for simplification purposes.

As used in the definitions of the symbols for the forces acting on the developer housing 14 (see FIG. 1) in FIG. 13, GS refers to gear side of the developer housing 14 (see FIG. 1). The gear side has the coupler 60 receiving the input from the Oldham coupler in the laser printer 11. NGS refers to the opposite side of the developer housing 14.

The definitions for the symbols of the forces on the developer housing 14 in FIG. 13 and in equations used to determine the minimum and maximum of each of the various utilized mechanical noise variables are as follows:

Fr Rear reaction force. (shown on NGS in FIG. 13 for simplification purposes but applied on GS)

Frf Rear reaction friction force ($Frf=Fr*\mu_r$) (shown on NGS in FIG. 13 for simplification purposes but applied on GS)

$\mu_r$ Coefficient of friction for rear support surface 17 engaging roller 19 and front support rollers 26 and 29. ($\mu_r=0.1$)

Lrx Distance from center of developer roll 55 to Fr, positive distance if in negative X direction. (Lrx=115 mm)

Lry Distance from center of developer roll 55 to Fr, positive distance if in negative Y direction. (Lry=13.6 mm)

Lrz Distance from center of developer roll 55 to Fr, positive distance if in positive Z direction. Control variable (Lrz=251 mm)

Fnl Normal reaction force from PC drum 70 on NGS end of developer roll 55.

Fnr Normal reaction force from PC drum 70 on GS end of developer roll 55.

Ffl Friction force between developer roll 55 and PC drum on 70 NGS. (Ffl=Fnl* $\mu_f$)

Ffr Friction force between developer roll 55 and PC drum on 70 GS. (Ffr =Fnr*$\mu_f$)

$\mu_f$ Coefficient of friction between developer roll 55 and PC drum 70. ($\mu_f$=0.7 ±0.21) (30%)

Lnr Distance to GS normal reaction force. (Lnr=231 mm)

Lr Distance to friction forces Ffl & Ffr in X axis direction (radius of developer roll 55).

(Lr=10 mm)

Fcl Front reaction force on NGS roller 29.

Fcr Front reaction force on GS roller 26.

Lc Distance from center of developer roll 55 to Fcl & Fcr lines of action (L4).

Positive distance is in positive X direction. Control variable (Lc=10 mm)

Fclf Front reaction friction force on NGS roller 29. (Fclf= Fcl*$\mu_f$)

Fcrf Front reaction friction force on GS roller 26. (Fcrf= Fcl*$\mu_f$)

Lcf Distance from center of developer roll 55 to Fclf, Fcrf lines of action in X-Y plane. Control variable (Lcf=29 mm)

β Angle between Fcl/Fcr & Fr line of action and X axis in X-Y plane. Control variable (β=85°)

Lclz Distance from end of developer roll 55 to Fcl, Fclf. Positive distance if in positive Z direction. (Lclz=−18.5 mm)

Lcrz Distance from end of developer roll 55 to Fcr, Fcrf. Positive distance if in positive Z direction. (Lcrz=251 mm)

Fsl Developer bias spring force for NGS spring 44. Control & noise variable. (Fsl=1.5 lbf±10%)

Fsr Developer bias spring force for GS spring 39. Control & noise variable. (Fsr=1.5 lbf±10%)

Lsl Perpendicular distance from center of developer roll 55 to NGS spring force line of action, positive if above center of developer roll 55. Control variable (Lsl=4 mm)

Lsr Perpendicular distance from center of developer roll 55 to GS spring force line of action, positive if above center of developer roll 55. Control variable (Lsr=2 mm)

Lslz Distance from center of developer roll 55 to NGS spring force in Z direction. Positive if in negative Z direction. (Lslz=33 mm)

Lsrz Distance from center of developer roll 55 to GS spring force in Z direction. Positive if in positive Z direction. (Lsrz=265 mm)

β1 Angle between NGS spring force line of action and X axis in X-Y plane. Negative angle if below X axis. Control & noise variable. (αl=−24°±0.5°)

αr Angle between GS spring force line of action and X axis in X-Y plane. Negative angle if below X axis. Control & noise variable. (αr=−2±0.5°)

θ Angle between Fw line of action and X axis in X-Y plane. Control & noise variable.

θ=85°±3°)

Fw Force from weight of entire developer housing 14. Noise variable.

(Fw=3.4 lbf−1.76)

Fe Force from electrical contacts 80–82. All three forces are combined into one force exerted on middle contact 81. Noise variable (Fe=0.33 bf)

Fef Force from friction between developer housing and printer electrical contacts (Fe* $\mu_e$)

$\mu_e$ Coefficient of friction between developer housing and printer contacts ($\mu_e$=0.5)

Lex Distance to electrical contact force in X direction. Positive distance is in positive X direction. (Lex=−13 mm)

Ley Distance to electrical contact force in Y direction. Positive distance is in negative Y direction. (Ley=13 mm)

Lez Distance to electrical contact force in Z direction. Positive distance is in positive Z direction. (Lez=−38.2 mm)

Fer Reaction force at developer housing locating tab 16A.

Ferf Force from friction between developer housing locating tab 16A and slot in cleaner housing 12 (Fer*$\mu_{er}$)

$\mu_{er}$ Coefficient of friction between developer housing locating tab 16A and slot in cleaner housing 12 ($\mu_{er}$=0.5)

Lerx Distance to Fer & Ferf at developer housing locating tab 16A in X direction. Positive distance is in negative X direction. (Lerx=25 mm)

Lery Distance to Fer & Ferf in Y direction. Positive distance is in positive Y direction. (Lery=49 mm)

Lerz Distance to Fer & Ferf in Z direction. Positive distance is in positive Z direction. (Lerz=236.5 mm)

Lwx Distance to center of gravity of developer housing 14 in X direction. Positive distance is in negative X direction. Described by equation Lwx=14.037*Fw+41.861

Lwz Distance to center of gravity of developer housing 14 in Z direction. Positive distance is in positive Z direction. (Lwz=115 mm)

Md Torque input to developer housing 14. (Md=40 Oz*in ±20=63.5 lbf*mm ±32)

Fox Force from Oldham coupler in the X direction. (Fox= 0.35 lbf ±0.22)

Foy Force from Oldham coupler in the Y direction. (Foy=0.0 lbf ÷0.3)

Loz Distance to application of Oldham coupler force in Z direction. Positive distance is in positive Z direction (Loz=258 mm)

Lox Distance to application of Oldham coupler force and torque in X direction. Positive distance is in negative X direction (Lox=−0.8 mm)

Loy Distance to application of Oldham coupler force and torque in Y direction. Positive distance is in positive Y direction (Loy=0.8 mm)

In determining the various mechanical noise variables, three assumptions are made. One is that all measurements are made only when the main drive motors of the laser printer 11 (see FIG. 1) are stopped. That is, measurements occur only when a pause in printing occurs in which the removable toner cartridge 10 is unloaded from its mechanical drive by back stepping the drive motors.

The second assumption is that vertical components of the friction forces are small and can be neglected in the analysis.

The third assumption is that periodic Oldham coupler forces are modeled as mechanical noise variables. These are the forces applied to the coupler 60.

In making the analysis, three functional constraints had to be met. The first functional constraint is that a consistent nip pressure between the developer roll 55 (see FIG. 7) and the PC drum 70 (see FIG. 8) must be maintained. The nip pressure is a prescribed force of about 3 lbf. distributed evenly across the nip and within a tolerance range insuring consistent print quality. The nip pressure is identified in FIG. 13 as a force on each end of the developer roll 55. The nip pressure constraint must be met while the developer roll 55, the PC drum 70 (see FIG. 8), and the laser printer motor are turning.

The second functional constraint on the developer housing 14 (see FIG. 1) is that all of the reaction forces remain in the same direction over the life of the removable toner cartridge 10. This avoids a "chattering" condition that would occur if the reaction forces changed direction. It is believed that "chattering" could possibly create a print quality defect.

The third functional constraint on the developer housing 14 is that changes in the toner weight are closely coupled to the rear reaction force on the developer housing 14. These three functional constraints must be met over the range of the mechanical noise variables.

The following equations of the various forces shown in FIG. 13 are used to determine the unknown reaction forces acting on the body of FIG. 13:

$$\sum F_X = F_{s1}\cos_{\alpha 1} + F_{sr}\cos\alpha_r + F_w\cos\theta - F_{n1} - F_{nr} - F_r\cos\beta - F_{c1}s\beta - F_{cr}\cos\beta - F_{rf} - F_{c1f} - F_{crf} - F_{ef} - F_{erf} + F_{ox} = 0$$

$$\sum F_Y = F_{s1}\sin_{\alpha 1} + F_{sr}\sin_{\alpha r} - F_w\sin\theta - F_r\sin\beta + F_{c1}\sin\beta + F_{cr}\sin\beta + F_{f1} + F_{fr} + F_{oy} = 0$$

$$\sum F_Z = F_e - F_{er} = 0$$

$$\sum M_X = -F_{s1}\sin_{\alpha 1}L_{s1z} + F_{sr}\sin_{\alpha r}L_{srz} - F_w\sin\theta L_{wz} + F_{fr}L_{nr} + F_r\sin\beta L_{rz} + F_{c1}\sin\beta L_{c1z} + F_{cr}\sin\beta L_{crz} + F_eL_{ey} + F_{er}L_{ery} + F_{oy}L_{oz} = 0$$

$$\sum M_Y = F_{s1}\cos_{\alpha 1}L_{s1z} - F_{sr}\cos\alpha_rL_{srz} - F_w\cos\theta L_{wz} + F_{nr}L_{nr} + F_r\cos\beta L_{rz} + F_{c1}\cos\beta L_{c1z} + F_{cr}\cos\beta L_{crz} + F_{rf}L_{rz} + F_{c1f}L_{c1z} + F_{crf}L_{crz} + F_eL_{ex} + F_{ef}L_{ez} + F_{er}L_{erx} + F_{erf}L_{erz} - F_{ox}L_{oz} = 0$$

$$\sum M_Z = M_d + F_{s1}L_{s1} + F_{sr}L_{sr} - F_wL_{wx} + F_rL_{rx} - F_{c1}L_c - F_{cr}L_c - F_{f1}L_r - F_{fr}L_r + F_{rf}L_{ry} - F_{c1f}L_{cf} - F_{crf}L_{cf} - F_{erf}L_{ery} + F_{ef}L_{ey} + F_{oy}L_{ox} + F_{ox}L_{oy} = 0$$

It should be understood that the developer housing 14 (see FIG. 1) must freely roll or slide to enable this invention to be utilized. It is not necessary that the biasing occur with the use of the springs 39 (see FIG. 3) and 44 (see FIG. 6). Any other suitable biasing means or resiliently connecting means may be employed.

After the minimum and maximum values of each of the mechanical noise variables have been determined, all of the various combinations of the minimum and maximum values of the mechanical noise variables are combined in a computer program to obtain the optimum design values.

Because of the large manufacturing tolerances of the springs 39 (see FIG. 3) and 44 (see FIG. 6), the vertical components of the spring forces need to be reduced to a minimum. Accordingly, as previously mentioned, the angle of the spring 39 (see FIG. 3) to the line connecting the centers of the developer roll 55 (see FIG. 7) and the PC drum 70 (see FIG. 8) is significantly reduced so that its vertical component is negligible.

Because a rigid body should have only three points of vertical support and the developer housing 14 (see FIG. 1) is a rigid body when measurements are made with the drive motors disconnected, the developer housing 14 can have only three fixed supports. Therefore, only one point on the rear of the developer housing 14 can be supported as the third of the three fixed supports; this is the gear side in the preferred embodiment.

It should be understood that all of the mechanical noise variables are created in the developer housing 14, not in the toner therein. Accordingly, the values of the mechanical noise variables remain substantially the same irrespective of the weight of the toner within the developer housing 14.

During optimization, sixty-four cases were run for each combination of the mechanical noise variables. These were employed to determine the optimum design values.

Figure 14:
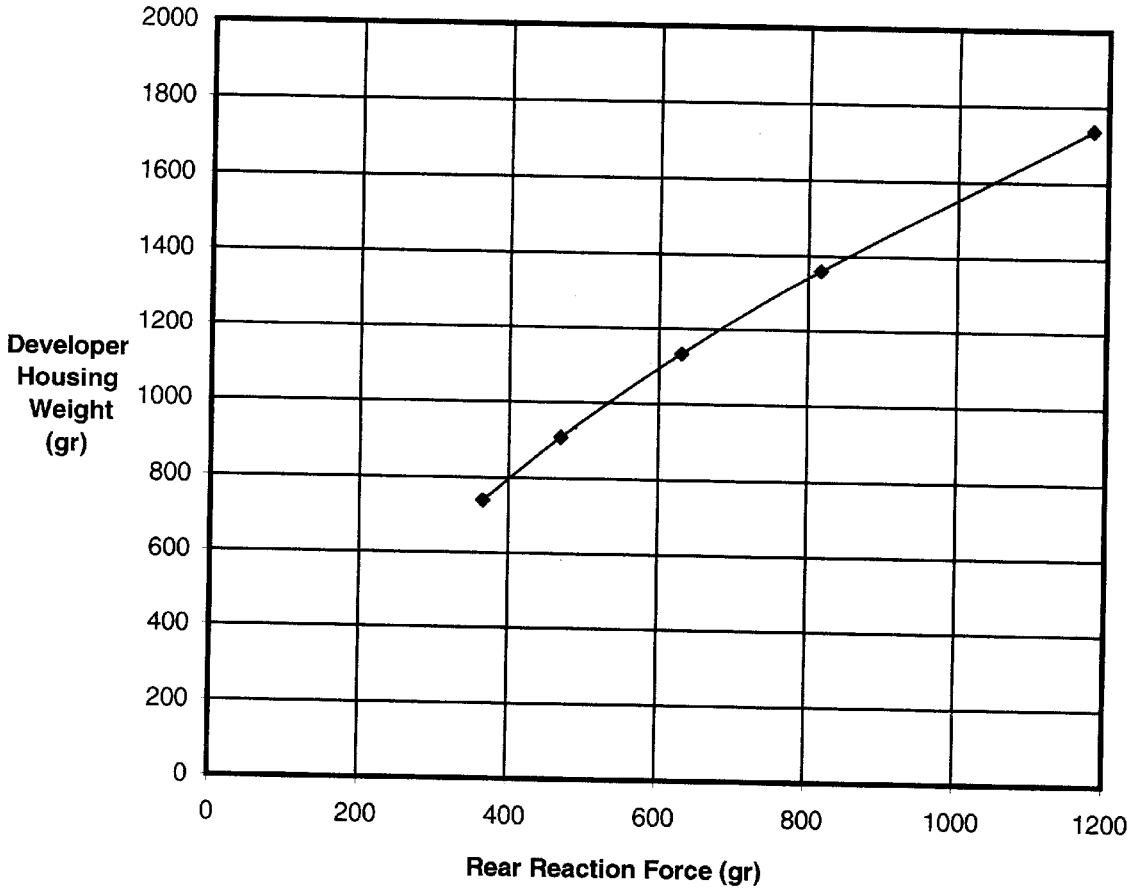
FIG. 14 is a graph disclosing the relation of the magnitude of the rear reaction force of the developer housing to the weight of the developer housing including the toner therein.

As a result, the rear reaction force transmitted by the support surface 17 on the developer housing 14 is determined by the load cell 20. The relationship of the magnitude of the weight of the developer housing 14 to the magnitude of the rear reaction force sensed by the load cell 20 is shown in FIG. 14.

Figure 15:
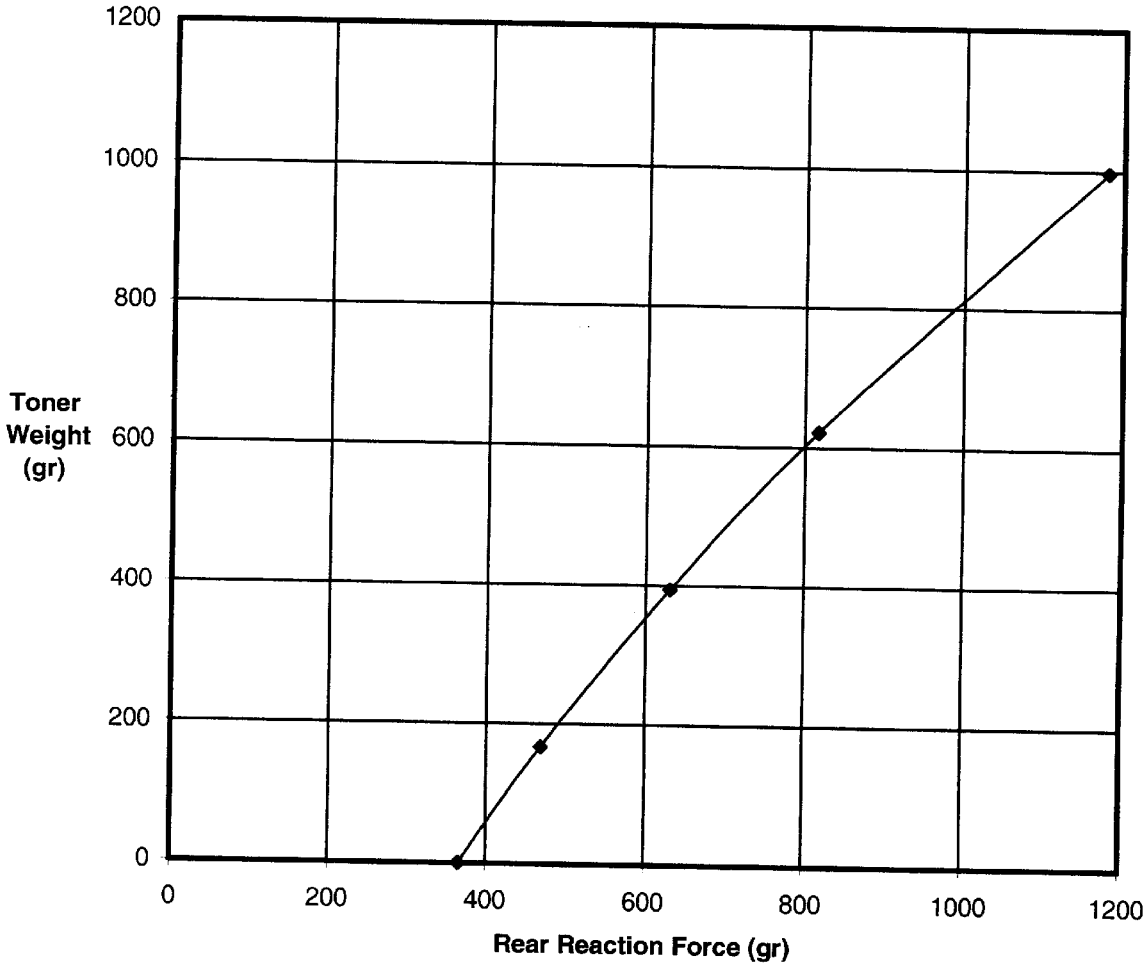
FIG. 15 is a graph showing the relation of the magnitude of the rear reaction force of the developer housing to the weight of the toner in the developer housing.

The relation of the magnitude of the toner weight in the developer housing 14 (see FIG. 1) to the magnitude of the rear reaction force transmitted from the support surface 17 on the developer housing 14 to the load cell 20 is disclosed in FIG. 15. This is obtained by a mathematical subtraction of the fixed weight of the developer housing 14 (see FIG. 1) from the total weight of the developer housing 14 with the toner therein.

Figure 17:
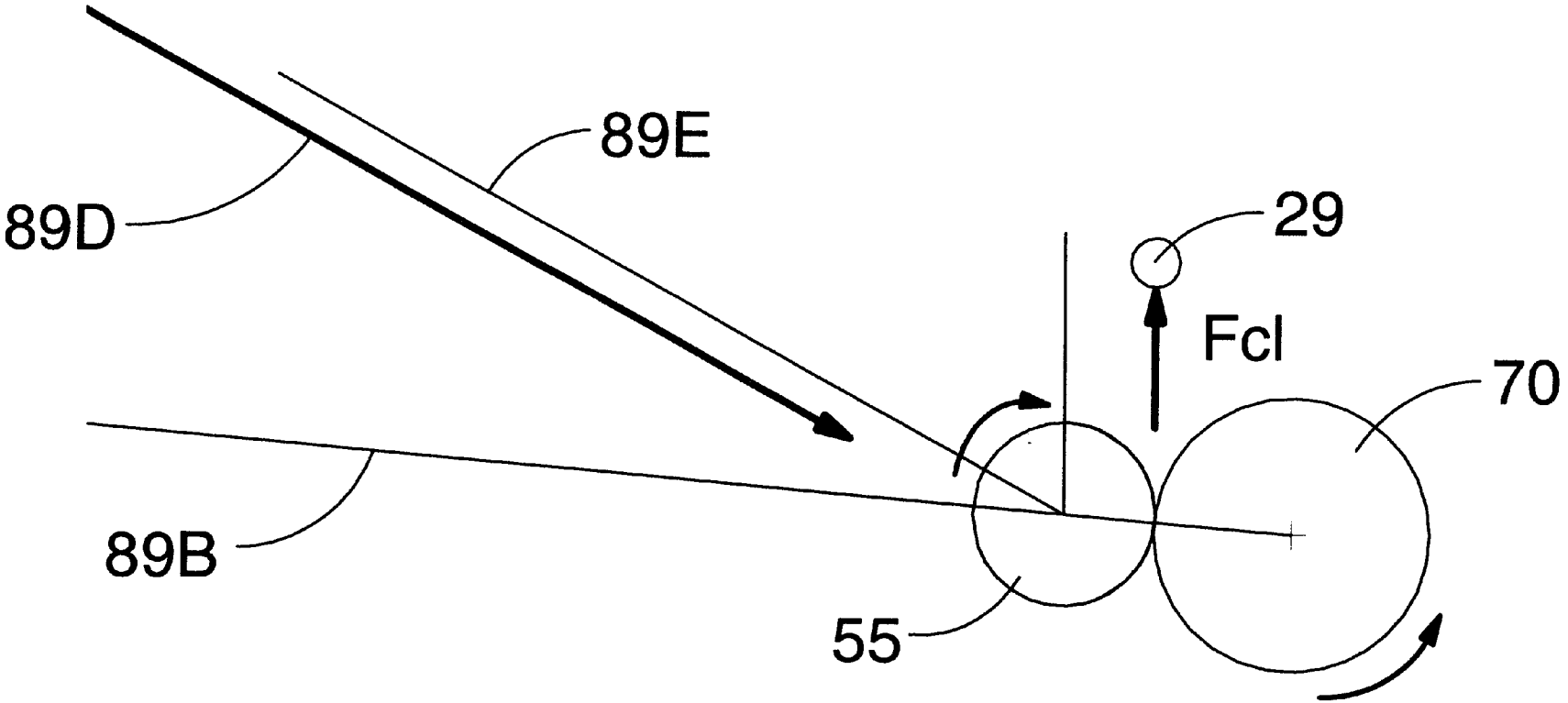
FIG. 17 is a schematic diagram showing the optimum position of the angle of the other of the springs and the location of the other of the front support rollers for slidably supporting the developer housing on the cleaner housing and taken from the same side as FIG. 2.

Through the analysis of the forces with the equations, it was discovered that the optimum positions of the biasing spring 39 (see FIG. 3) and the front support roller 26 are as shown in FIG. 16 and the optimum positions of the biasing spring 44 (see FIG. 3) and the front support roller 29 are as shown in FIG. 17 while still meeting the three functional constraints.

As indicated in FIG. 16 by its force line of action 89A, the biasing spring 39 (see FIG. 3) is at an angle of 20 to X-axis 89B, which passes through the centers of the developer roll 55 and the PC drum 70. The force line of action 89A is offset 2 mm from the center of the developer roll 55 as indicated by its spacing from a line 89C, which is parallel to the force line of action 89A and passes through the center of the developer roll 55. Thus, the force line of action 89A produces a force acting below the center or axis of the developer roll 55.

As indicated in FIG. 17 by its force line of action 89D, the biasing spring 44 (see FIG. 6) is at an angle of 24° to the X-axis 89B. The force line of action 89D is offset 4 mm from the center of the developer roll 55 as indicated by its spacing from a line 89E, which is parallel to the force line of action 89D and passes through the center of the developer roll 55. Thus, the force line of action 89D produces a force acting below the center or axis of the developer roll 55.

The reaction forces created by the support rollers 26 (see FIG. 7) and 29 are disposed over the length of the nip between the developer roll 55 and the PC drum 70 (see FIG. 8). The rear reaction force, Fr (see FIG. 13), is placed on the same side of the developer housing 14 (see FIG. 1) as the coupler 60 through the support surface 17 with the support surface 17 having the rear reaction force preferably applied 115 mm from the center of the developer roll 55 (see FIG. 7).

The centers of the support rollers 26 and 29 are aligned with the nip between the developer roll 55 and the PC drum 70 as shown in FIGS. 16 and 17, respectively. Accordingly, the center of each of the support rollers 26 and 29 is 10 mm from the center of the developer roll 55 as shown in FIGS. 16 and 17, respectively.

It was discovered that the mechanical noise variables could vary Fr by ±13 grams for a given toner load. The previously suggested torque sensing system would have the same mechanical noise variables cause Fr to vary by ±18 grams. This is a significant improvement in accuracy in determining the weight of the remaining toner at any time.

While the side wall 27 (see FIG. 2) of the developer housing 14 could have the support surface 77 transmit the rear reaction force to the load cell 20 rather than the support surface 17 (see FIG. 1) on the side wall 18 of the developer housing 14 as previously mentioned, this would require the angle of the biasing spring 44 (see FIG. 6) to be very small and the angle of the biasing spring 39 (see FIG. 3) to be larger.

Furthermore, the rear reaction force could be transmitted from the rear of the developer housing 14 through a flat surface disposed between its sides. If the rear reaction force is transmitted from a flat surface at the middle of the rear of the developer housing 14, the springs 39 and 44 (see FIG. 6) would be mounted at the same angle to the line connecting the centers of the developer roll 55 (see FIG. 7) and the PC drum 70 (see FIG. 8) and offset the same amount from the X-axis so that each spring force acts below the axis of the developer roll 55 (see FIG. 7).

Figure 18:
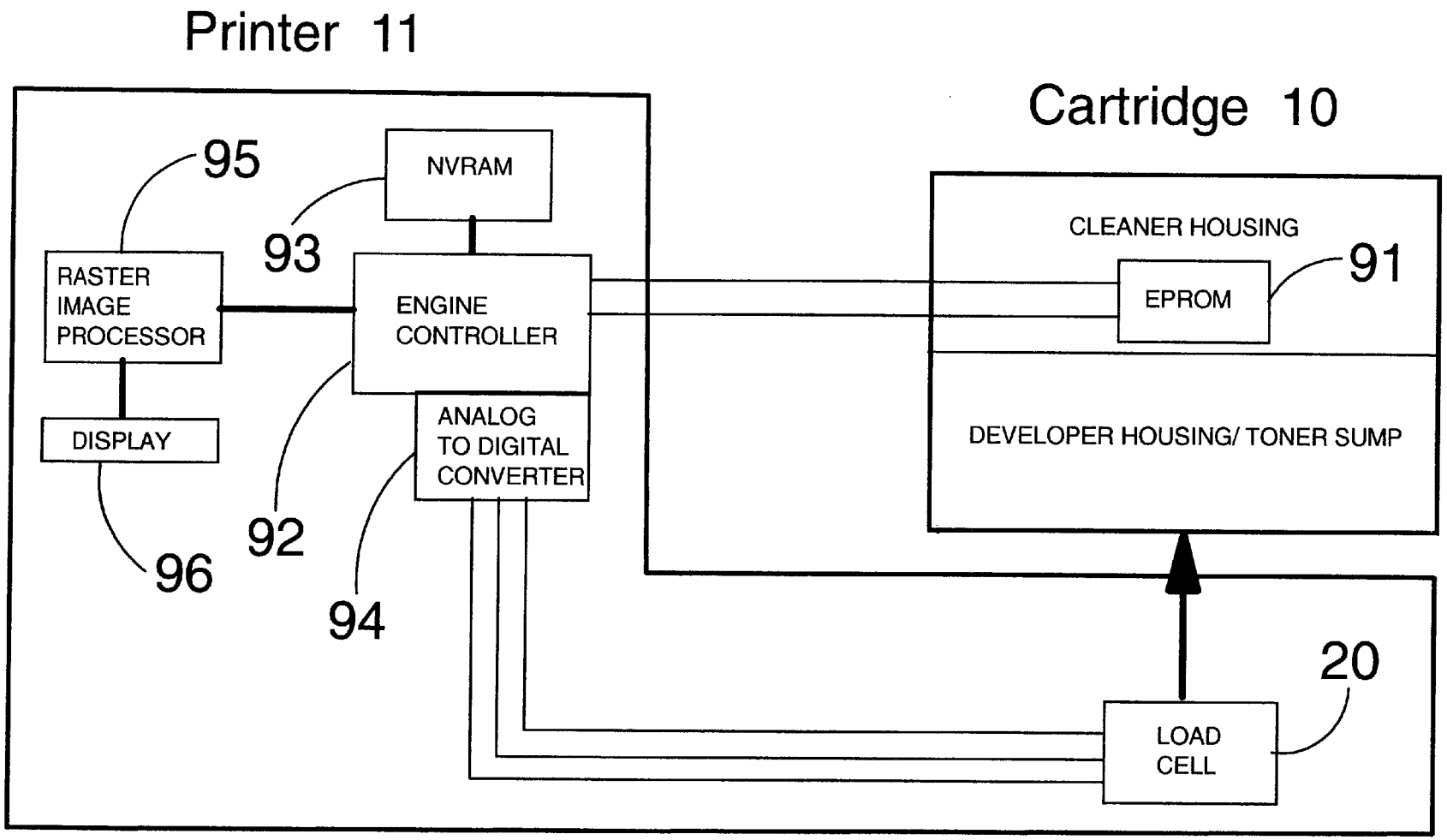
FIG. 18 is a block diagram showing an arrangement for determining the remaining toner weight, storing it, and displaying the percentage of toner remaining.

The cleaner housing 12 (see FIG. 1) has an EPROM 91 (see FIG. 18) supported thereon. One suitable example of the EPROM 91 with its support on the cleaner housing 12 (see FIG. 1) is more particularly shown and described in U. S. Pat. No. 5,995,774 to Applegate et al, which is owned by the assignee of this application.

The EPROM 91 (see FIG. 18) obtains the initial weight of the toner within the developer housing 14 (see FIG. 1). An example of the initial toner weight is 1,000 grams.

The EPROM 91 (see FIG. 18) also has a second order polynomial equation correlating the relation of the rear reaction force and the weight of the toner. This equation is:

$$Y=0.0004X^2+1.8988X-630.56$$

in which X is the rear reaction force and Y is the toner weight.

The laser printer 11 (see FIG. 1) has an engine controller 92 (see FIG. 18), which reads both the initial toner weight and the correlation equation from the EPROM 91. These values are stored in NVRAM 93, which is a non-volatile RAM, for subsequent use in calculations.

When the laser printer 11 (see FIG. 1) is not printing through not driving the removable toner cartridge 10, the rear reaction force is measured by the load cell 20 or other suitable force sensor. This force is transmitted by the load cell 20 through an analog to digital converter 94 (see FIG. 18) to the engine controller 92.

If the rear reaction force is 800 grams, for example, then the engine controller 92 calculates that the toner weight is 632 grams through the second order polynomial equation. The engine controller 92 next calculates the percentage of the toner remaining in the developer housing 14 (see FIG. 1) as 63.2% through dividing the remaining toner weight (632 grams) by the initial toner weight (1,000 grams).

The engine controller 92 (see FIG. 18) then sends the percentage of the toner remaining to a raster image processor 95. The raster image processor 95 drives a display 96. The display 96 may either display the percentage numerically or in the form of a bar graph, for example. This data also may be displayed on network control software or on a printed test page.

It should be understood that the graph of FIG. 15 is dependent on the design point of the removable toner cartridge 10 (see FIG. 1). The design point in FIG. 15 is based on the material of the doctor blade 78 (see FIG. 5) being steel. If the material of the doctor blade 78 were changed to aluminum, for example, this would produce a significant reduction in the weight of the developer housing 14.

As a result, the curve in FIG. 15 would shift to the left and its slope would change. Accordingly, if the weight of the developer housing 14 (see FIG. 1) changes, then the correlation equation, which is stored in the EPROM 91 (see FIG. 18), must be revised to agree with this change in weight relationship. That is, the second order polynomial equation must be altered because of the change in the design point of the removable toner cartridge 10 (see FIG. 1). Other mechanical design changes would produce a similar effect on the weight relationship.

An advantage of this invention is a less costly removable toner cartridge. Another advantage of this invention is that the removable toner cartridge has less parts than prior designs. A further advantage of this invention is that the weight of the toner is more accurately measured over a substantially larger range. Still another advantage of this invention is that information as to the weight of the remaining toner at any desired time may be used for other purposes. A still further advantage of this invention is that an increased measurement range of the weight of the remaining toner is obtained. Yet another advantage of this invention is that it substantially minimizes mechanical noise variables that could affect the rear reaction force which is measured to ascertain the weight of the toner.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A removable toner cartridge for use in an image forming apparatus including:

a developer housing;

a cleaner housing receiving said developer housing and providing support thereto;

first biasing means for resiliently connecting one side of said developer housing and one side of said cleaner housing to each other;

second biasing means for resiliently connecting the other side of said developer housing and the other side of said cleaner housing to each other;

said developer housing and said cleaner housing having cooperating means for allowing movement of said developer housing relative to said cleaner housing;

said developer housing having toner stored therein;

a photoconductive drum rotatably supported by said cleaner housing;

a developer roll rotatably supported by said developer housing and engaging said photoconductive drum to form a nip therebetween, said developer roll transferring toner from said developer housing to said photoconductive drum when said developer roll and said photoconductive drum are rotated;

said developer housing having input receiving means for receiving an input to cause rotation of said developer roll;

said cleaner housing having input receiving means for receiving an input to cause rotation of said photoconductive drum;

and said developer housing having force transmitting means for transmitting a force exerted on one of the sides of said developer housing indicative of the amount of toner stored in said developer housing when said removable toner cartridge is disposed in an image forming apparatus and said developer roll and said photoconductive drum are not rotated.

2. The removable toner cartridge according to claim 1 in which:

said cooperating means of said cleaner housing includes an upper roller support shelf and a lower roller support shelf adjacent each of its sides;

said upper roller support shelf and said lower roller support shelf on each side of said cleaner housing are disposed the same vertical distance from each other;

and said cooperating means of said developer housing includes:

a support roller adjacent each of its sides;

one of said support rollers engaging only said lower support shelf on one side of said cleaner housing and the other of said support rollers engaging only said upper support shelf on the other side of said cleaner housing whereby said developer housing is continuously urged by said first and second biasing means towards said cleaner housing to maintain said developer roll in engagement with said photoconductive drum;

and said other support roller being disposed on the same side of said developer housing as said force transmitting means.

3. The removable toner cartridge according to claim 2 in which:

said first biasing means is a first spring connecting one side of said developer housing to one side of said cleaner housing;

said second biasing means is a second spring connecting the other side of said developer housing to the other side of said cleaner housing;

said first spring has a smaller angle to a line connecting the centers of said developer roll and said photoconductive drum than said second spring;

and said first spring is disposed on the same side of said developer housing as said force transmitting means.

4. The removable toner cartridge according to claim 3 in which each of said first and second springs produces a force acting below the axis of said developer roll with each force line being a different distance from the axis of said developer roll.

5. The removable toner cartridge according to claim 4 in which:

each of said support rollers is disposed above said developer roll and said photoconductive drum;

and the axes of said support rollers are in a substantially vertical plane extending through the nip between said developer roll and said photoconductive drum.

6. The removable toner cartridge according to claim 5 in combination with an image forming apparatus within which said removable toner cartridge is disposed, said image forming apparatus having determining means for determining the force transmitted by said force transmitting means, and said force transmitting means of said developer housing including support means for supporting one side of said developer housing adjacent its rear on said determining means of said image forming apparatus in a point contact relation.

7. The combination according to claim 6 in which said determining means includes a force sensor for determining the force transmitted by said force transmitting means.

8. The combination according to claim 7 in which:

said force sensor includes:

a load cell;

and a roller rotatably supported by said load cell;

and said support means of said force transmitting means engages said roller in a point contact relation to transmit the force from said developer housing through said roller to said load cell.

9. The combination according to claim 8 in which said support means of said force transmitting means includes a substantially horizontal flat surface on said developer housing adjacent its rear engaging said roller of said force sensor.

10. The combination according to claim 7 including means for ascertaining the amount of toner in said developer housing in accordance with the force determined by said force sensor.

11. The removable toner cartridge according to claim 4 in combination with an image forming apparatus within which said removable toner cartridge is disposed, said image forming apparatus having determining means for determining the force transmitted by said force transmitting means, and said force transmitting means of said developer housing including support means for supporting one side of said developer housing adjacent its rear on said determining means of said image forming apparatus in a point contact relation.

12. The removable toner cartridge according to claim 3 in combination with an image forming apparatus within which said removable toner cartridge is disposed, said image forming apparatus having determining means for determining the force transmitted by said force transmitting means, and said force transmitting means of said developer housing including support means for supporting one side of said developer housing adjacent its rear on said determining means of said image forming apparatus in a point contact relation.

13. The removable toner cartridge according to claim 3 in which:

each of said support rollers is disposed above said developer roll and said photoconductive drum;

and the aligned axes of said support rollers are substantially horizontal and are in a substantially vertical plane extending through the nip between said developer roll and said photoconductive drum.

14. The removable toner cartridge according to claim 2 in combination with an image forming apparatus within which said removable toner cartridge is disposed, said image forming apparatus having determining means for determining the force transmitted by said force transmitting means, and said force transmitting means of said developer housing including support means for supporting one side of said developer housing adjacent its rear on said determining means of said image forming apparatus in a point contact relation.

15. The combination according to claim 14 in which said determining means includes a force sensor for determining the force transmitted by said force transmitting means.

16. The combination according to claim 14 in which:

said force sensor includes:

a load cell;

and a roller rotatably supported by said load cell;

and said support means of said force transmitting means engages said roller in a point contact relation to transmit the force from said developer housing through said roller to said load cell.

17. The combination according to claim 16 in which said support means of said force transmitting means includes a substantially horizontal flat surface on said developer housing adjacent its rear engaging said roller of said force sensor.

18. The combination according to claim 14 including means for ascertaining the amount of toner in said developer housing in accordance with the force determined by said force sensor.

19. The combination according to claim 2 in which:

said upper roller support shelf and said lower roller support shelf on one of the sides of said cleaner housing are disposed higher than said upper roller support shelf and said lower roller support shelf on the other side of said cleaner housing;

and said support rollers have their axes aligned.

20. The combination according to claim 2 in which:

said upper roller support shelves are disposed in the same horizontal plane;

said lower roller support shelves are disposed in the same horizontal plane;

and said support rollers have their axes parallel to each other.

21. The removable toner cartridge according to claim 2 in combination with an image forming apparatus within which said removable toner cartridge is disposed in which:

said image forming apparatus has determining means for determining the force transmitted by said force transmitting means;

said force transmitting means of said developer housing includes support means for supporting one side of said developer housing adjacent its rear on said determining means of said image forming apparatus in a point contact relation;

said determining means includes:

storage means supported by one of said cleaner housing and said developer housing;

and said storage means having stored therein a second order polynominal equation describing the relationship between the transmitted force and the amount of toner in said developer housing;

controlling means for receiving the value of the force from said determining means and the second order polynominal equation from said storage means for determining the amount of toner stored in said developer housing;

and indicating means for indicating the amount of toner stored in said developer housing in accordance with the stored second order polynominal equation in said storage means.

22. The combination according to claim 21 in which said storage means is an EPROM.

23. The removable toner cartridge according to claim 2 in which said force transmitting means transmits a force exerted on a portion of the rear of said developer housing.

24. The removable toner cartridge according to claim 23 in which:

said first biasing means is a first spring connecting one side of said developer housing to one side of said cleaner housing;

said second biasing means is a second spring connecting the other side of said developer housing to the other side of said cleaner housing;

and each of said first and second springs produces a force acting below the axis of said developer roll.

25. The removable toner cartridge according to claim 24 in combination with an image forming apparatus within which said removable toner cartridge is disposed, said image forming apparatus having determining means for determining the force transmitted by said force transmitting means, and said force transmitting means of said developer housing including support means for supporting one point of said developer housing adjacent its rear on said determining means of said image forming apparatus in a point contact relation.

26. The removable toner cartridge according to claim 2 in which:

each of said support rollers is disposed above said developer roll and said photoconductive drum;

and the axes of said support rollers are in a substantially vertical plane extending through the nip between said developer roll and said photoconductive drum.

27. The removable toner cartridge according to claim 2 in combination with an image forming apparatus within which said removable toner cartridge is disposed, said image forming apparatus having determining means for determining the force transmitted by said force transmitting means, and said force transmitting means of said developer housing including support means for supporting one side of said developer housing adjacent its rear on said determining means of said image forming apparatus in a point contact relation.

28. The combination according to claim 27 in which said determining means includes a force sensor for determining the force transmitted by said force transmitting means.

29. The combination according to claim 28 in which:

said force sensor includes:

a load cell;

and a roller rotatably supported by said load cell;

and said support means of said force transmitting means engages said roller in a point contact relation to transmit the force from said developer housing through said roller to said load cell.

30. The removable toner cartridge according to claim 2 in which each of said first and second biasing means is disposed at a different angle to a line connecting the centers of said developer roll and said photoconductive drum.

31. A method of ascertaining the amount of usable toner remaining at any time in a removable toner cartridge installed in an image forming apparatus in which the removable toner cartridge has a cleaner housing receiving a developer housing having the toner therein and resiliently connected thereto with the developer housing rotatably supporting a developer roll and the cleaner housing rotatably supporting a photoconductive drum including:

determining a rear reaction force exerted by the developer housing at any time that the image forming apparatus is not driving the developer roll in the developer housing and the photoconductive drum in the cleaner housing;

and using the determined force to ascertain the weight of the toner remaining in the developer housing.

32. The method according to claim 31 including displaying the amount of toner remaining in the developer housing at any time.

33. A method of controlling the magnitudes of the forces acting on a developer housing of a removable toner cartridge installed in an image forming apparatus in which the developer housing is received in a cleaner housing of the removable toner cartridge with the developer housing rotatably supporting a developer roll, the cleaner housing rotatably supporting a photoconductive drum, and the developer housing resiliently connected to the cleaner housing by a pair of biasing springs connecting each side of the developer housing to one of the sides of the cleaner housing so that the magnitude of a rear reaction force at a point adjacent the rear of the developer housing is indicative of the weight of the toner remaining in the developer housing including:

disposing each of the biasing springs at a relatively small angle to a line connecting the centers of the developer roll and the photoconductive drum so that each has a relatively small vertical force component;

and optimizing other variable forces acting on the developer housing.

34. The method according to claim 33 in which the rear reaction force is on the side of the developer housing having the input for rotating the developer roll in the developer housing and disposing each of the springs so that the angle to the line connecting the centers of the developer roll and the photoconductive drum of the biasing spring on the side of the developer housing having the rear reaction force is smaller than the angle to the line connecting the centers of the developer roll and the photoconductive drum of the biasing spring on the other side of the developer housing.

35. The method according to claim 34 in which the angle to the line connecting the centers of the developer roll and the photoconductive drum of the biasing spring on the side of the developer housing having the rear reaction force is less than 5° and the angle to the line connecting the centers of the developer roll and the photoconductive drum of the biasing spring on the other side of the developer housing is less than 25°.

36. The method according to claim 34 in which the angle to the line connecting the centers of the developer roll and the photoconductive drum of the biasing spring on the side of the developer housing having the rear reaction force is in the range of 2°–4° and the angle to the line connecting the centers of the developer roll and the photoconductive drum of the biasing spring on the other side of the developer housing is in the range of 22°24°.

37. The method according to claim 33 in which the rear reaction force is on the side of the developer housing having the input for rotating the developer roll in the developer housing and disposing each of the springs so that each of said first and second springs produces a force acting below the axis of the developer roll with each force line being a different distance from the axis of the developer roll.

* * * * *